US009864287B2

(12) United States Patent
Iida et al.

(10) Patent No.: US 9,864,287 B2
(45) **Date of Patent: *Jan. 9, 2018**

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Yoshifumi Iida, Kanagawa (JP); Hiroyoshi Okuno, Kanagawa (JP); Satoshi Inoue, Kanagawa (JP); Tomohito Nakajima, Kanagawa (JP); Yuka Zenitani, Kanagawa (JP); Yoshifumi Eri, Kanagawa (JP); Takeshi Iwanaga, Kanagawa (JP); Sakae Takeuchi, Kanagawa (JP); Shunsuke Nozaki, Tokyo (JP); Yasuo Kadokura, Kanagawa (JP); Yasuhisa Morooka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/219,950

(22) Filed: Jul. 26, 2016

(65) Prior Publication Data

US 2017/0227870 A1 Aug. 10, 2017

(30) Foreign Application Priority Data

Feb. 10, 2016 (JP) ..... 2016-024135

(51) Int. Cl.

| | |
|---|---|
| ***G03G 9/097*** | (2006.01) |
| ***G03G 9/08*** | (2006.01) |
| ***G03G 9/087*** | (2006.01) |
| ***G03G 15/08*** | (2006.01) |

(52) U.S. Cl.

CPC ..... *G03G 9/0825* (2013.01); *G03G 9/08755* (2013.01); *G03G 9/09716* (2013.01); *G03G 9/09725* (2013.01); *G03G 15/0865* (2013.01)

(58) Field of Classification Search

CPC ..... G03G 9/09725; G03G 9/09716; G03G 9/0825

USPC ..... 430/108.7

See application file for complete search history.

(56) References Cited

U.S. PATENT DOCUMENTS

| | | | | |
|---|---|---|---|---|
| 6,057,073 | A | 5/2000 | Hagiwara | |
| 6,316,155 | B1 | 11/2001 | Kudo et al. | |
| 6,777,151 | B2 | 8/2004 | Hagi et al. | |
| 8,021,814 | B2 * | 9/2011 | Hagi | G03G 9/081 430/108.8 |
| 2001/0051270 | A1 | 12/2001 | Yamashita et al. | |
| 2003/0129510 | A1 | 7/2003 | Hagi et al. | |
| 2003/0232185 | A1 | 12/2003 | Shimamura et al. | |
| 2007/0201917 | A1 | 8/2007 | Teshigawara | |
| 2009/0067894 | A1 | 3/2009 | Yamada et al. | |
| 2010/0203441 | A1 | 8/2010 | Kataoka et al. | |
| 2011/0065035 | A1 | 3/2011 | Anno et al. | |
| 2011/0177444 | A1 | 7/2011 | Mattison, Jr. et al. | |
| 2012/0189851 | A1 | 7/2012 | Zenitani et al. | |
| 2012/0237864 | A1 | 9/2012 | Saito et al. | |
| 2013/0071781 | A1 | 3/2013 | Saito et al. | |
| 2013/0196259 | A1 | 8/2013 | Iida et al. | |
| 2014/0057107 | A1 | 2/2014 | Zenitani et al. | |
| 2014/0370427 | A1 * | 12/2014 | Sasaki | G03G 9/09725 430/105 |
| 2016/0139521 | A1 | 5/2016 | Tsuda et al. | |
| 2017/0073236 | A1 | 3/2017 | Okuno et al. | |

FOREIGN PATENT DOCUMENTS

| | | | |
|---|---|---|---|
| EP | 1 845 419 | A2 | 10/2007 |
| EP | 2 479 208 | A1 | 7/2012 |
| JP | 2000-330328 | A | 11/2000 |
| JP | 2002-256170 | | 9/2002 |
| JP | 2003-167381 | A | 6/2003 |
| JP | 2003-202702 | A | 7/2003 |
| JP | 2005-125258 | A | 5/2005 |
| JP | 2006-154479 | | 6/2006 |
| JP | 2006-206413 | | 8/2006 |
| JP | 2007-279607 | A | 10/2007 |
| JP | 2009-098700 | A | 5/2009 |
| JP | 4347201 | B2 | 10/2009 |
| JP | 2009-292915 | A | 12/2009 |
| JP | 2010-185999 | A | 8/2010 |
| JP | 2011-059586 | A | 3/2011 |
| JP | 4758655 | B2 | 8/2011 |
| JP | 4828032 | B2 | 11/2011 |
| JP | 2013166667 | A | 8/2013 |
| JP | 2014-029511 | A | 2/2014 |
| JP | 2014-162678 | A | 9/2014 |
| JP | 2014-185069 | A | 10/2014 |

OTHER PUBLICATIONS

U.S. Appl. No. 15/205,951, filed Jul. 8, 2016 in the name of Inoue et al.

Apr. 14, 2017 Office Action issued in U.S. Appl. No. 15/218,781.

U.S. Appl. No. 15/218,781, filed Jul. 25, 2016 in the name of Morooka et al.

U.S. Appl. No. 15/001,950, filed Jan. 20, 2016 in the name of Okuno et al.

* cited by examiner

*Primary Examiner* — Janis L Dote

(74) *Attorney, Agent, or Firm* — Oliff PLC

(57) ABSTRACT

An electrostatic charge image developing toner includes kneaded and pulverized toner particles that contain a binder resin and a release agent, the release agent being partially exposed, and an external additive that contains silica particles having a compression aggregation degree of from 60% to 95% and a particle compression ratio of from 0.20 to 0.40.

10 Claims, 3 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-024135 filed Feb. 10, 2016.

BACKGROUND

1. Technical Field

The present invention relates to an electrostatic charge image developing toner, an electrostatic charge image developer, and a toner cartridge.

2. Related Art

A method of visualizing image information from an electrostatic charge image by electrophotography has been recently used in various fields. By the electrophotography, image information is formed as an electrostatic charge image on a surface of an image holding member (photoreceptor) in charging and exposure processes, a toner image is developed on the surface of the photoreceptor by using a developer containing a toner, the toner image is subjected to a transfer process for transferring the toner image to a recording medium such as a sheet and a fixing process for fixing the toner image on the surface of the recording medium, and the image is thus visualized.

SUMMARY

According to an aspect of the invention, there is provided an electrostatic charge image developing toner including:

kneaded and pulverized toner particles that contain a binder resin and a release agent, the release agent being partially exposed; and an external additive that contains silica particles having a compression aggregation degree of from 60% to 95% and a particle compression ratio of from 0.20 to 0.40.

BRIEF DESCRIPTION OF THE DRAWINGS

Exemplary embodiments of the present invention will be described in detail based on the following figures, wherein.

DETAILED DESCRIPTION

Figure 1:
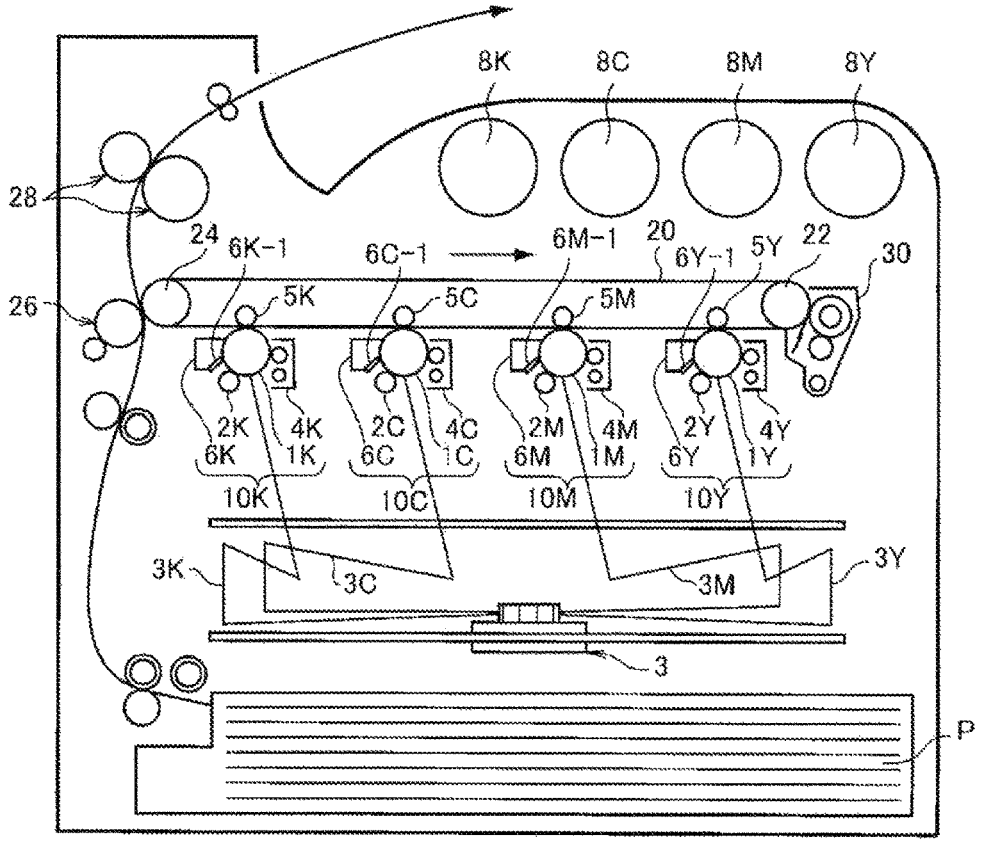
FIG. 1 is a configuration diagram schematically illustrating an example of an image forming apparatus according to an exemplary embodiment.

Hereinafter, description will be given of an exemplary embodiment of the invention as an example.

Electrostatic Charge Image Developing Toner

An electrostatic charge image developing toner (hereinafter, referred to as a "toner") according to the exemplary embodiment is a toner that includes kneaded and pulverized toner particles with a release agent partially exposed (hereinafter, also simply referred to as "toner particles") and an external additive.

The external additive contains silica particles with a compression aggregation degree from 60% to 95% and a particle compression ratio from 0.20 to 0.40 (hereinafter, also referred to as "specific silica particles").

Here, if an externally added structure of silica particles (a state where the silica particles adhere to toner particles) changes in a toner in the related art in which the silica particles are externally added to the toner particles, then fluidity of the toner may deteriorate, and a charge holding property may deteriorate. The charge holding property tends to deteriorate in an environment at a low temperature and low humidity. The silica particles move on the toner particles and are localized, or the silica particles flake from the toner particles, for example, and these are reasons of the change in the externally added structure.

In contrast, the silica particles externally added to the toner particles flake from the toner particles due to a mechanical burden caused by stirring in a developing unit or scraping in the cleaning unit, for example, in some cases. If the flaking silica particles reach the cleaning unit, then the silica particles are stopped at a tip end of the cleaning unit (a site of a contact portion between the cleaning blade and the photoreceptor on a downstream side in a rotation direction) and forms an aggregate (hereinafter, also referred to as an "externally added dam") by a pressure from the cleaning blade. The externally added dam contributes to an improvement in a cleaning property.

However, if the same image is repeatedly formed, then the state in which the silica particles flaking from the toner particles are partially stopped at the cleaning unit is obtained, and the silica particles tend to pass through the cleaning unit. The silica particles may damage the photoreceptor when the silica particles pass through the cleaning unit. The crack of the photoreceptor is considered to occur due to scraping of the photoreceptor when the silica particles pass through the cleaning blade.

In particular, kneaded and pulverized toner particles containing a release agent have irregular shapes, and a part of the release agent is exposed since the toner particles crack and are pulverized at portions corresponding to the release agent in a preparation process. The kneaded and pulverized toner particles do not easily adhere to the silica particles in a substantially uniform state due to the irregular shapes, and tend to be held by the exposed portion of the release agent and be localized due to adhesion force of the release agent if the silica particles move on the toner particles. Therefore, the kneaded and pulverized toner particles exhibit high tendencies in that the fluidity of the toner deteriorates and the charge holding property deteriorates.

If a large amount of silica particles are externally added to increase coverage of the silica particles or a large-diameter silica particles (such as silica particles with an average equivalent circle diameter from 100 nm to 300 nm) with a high buffer function (spacer function) are externally added for the purpose of preventing the deterioration of fluidity of the kneaded and pulverized toner particles with high adhesion force with a release agent partially exposed and enhancing the fluidity, then the silica particles tend to flake. Therefore, the amount of the flaking silica particles that reach the cleaning unit increases, the silica particles tend to pass through the cleaning unit, and the tendency that cracks are caused on the photoreceptor increases.

Thus, the toner according to the exemplary embodiment exhibits an excellent charge holding property in an environment at a low temperature and low humidity and prevents cracks on the photoreceptor when the same image is repeatedly formed, by externally adding the specific silica particles to the kneaded and pulverized toner particles. If the toner according to the exemplary embodiment is applied to an image forming apparatus, image defects (such as a temporal change in image density) due to the deterioration of the charge holding property of the toner and the crack on the photoreceptor when the same image is repeatedly formed are prevented. The reason thereof is inferred as follows.

The specific silica particles with the compression aggregation degree and the particle compression ratio within the above ranges are silica particles that have characteristics such as high fluidity, high dispersibility in the toner particles, a high cohesion, and high adhesion to the toner particles.

Here, silica particles typically have low adhesion and a characteristic of not easily aggregating since the silica particles have low bulk density while the silica particles exhibit satisfactory fluidity.

In contrast, a technique of treating surfaces of the silica particles by using a hydrophobizing agent for the purpose of enhancing both fluidity of the silica particles and dispersibility in the toner particles is known. According to the technique, the fluidity of the silica particles and the dispersibility in the toner particles are enhanced while the cohesion is maintained to be low.

In addition, a technique of treating the surfaces of the silica particles by using both a hydrophobizing agent and silicone oil is also known. According to the technique, the adhesion to the toner particles and the cohesion are enhanced. On the other hand, the fluidity and the dispersibility in the toner particles tend to deteriorate.

That is, it is possible to state that the fluidity and the dispersibility in the toner particles are in a conflict relationship with the cohesion and the adhesion to the toner particles in the silica particles.

In contrast, the specific silica particles have four satisfactory properties, namely the fluidity, the dispersibility in the toner particles, the cohesion, and the adhesion to the toner particles, by setting the compression aggregation degree and the particle compression ratio within the above ranges as described above.

Next, description will be given of meaning that the compression aggregation degree and the particle compression ratio of the specific silica particles are set within the above ranges in order.

First, description will be given of meaning that the compression aggregation degree of the specific silica particles is set to the range from 60% to 95%.

The compression aggregation degree is an index indicating the cohesion of the silica particles and the adhesion to the toner particles. The index is indicated by how difficult a silica particle compact is disentangled in a case of dropping the silica particle compact after obtaining the compact by compressing a silica particle.

Therefore, the silica particles tend to have higher bulk density, higher cohesive force (intermolecular force), and higher adhesion to the toner particles as the compression aggregation degree increases. A method of calculating the compression aggregation degree will be described later in detail.

Therefore, the specific silica with a compression aggregation degree that is controlled to be as high as 60% to 95% has satisfactory adhesion to the toner particles and cohesion. However, the upper limit of the compression aggregation degree is set to 95% in terms of obtaining satisfactory adhesion to the toner particles and satisfactory cohesion while securing the fluidity and the dispersibility in the toner particles.

Next, description will be given of the meaning that the particle compression ratio of the specific silica particles is set to be from 0.20 to 0.40.

The particle compression ratio is an index indicating the fluidity of the silica particles. Specifically, the particle compression ratio is represented by a ratio ((hardened apparent specific gravity−loosened apparent specific gravity)/hardened apparent specific gravity) between a difference of the hardened apparent specific gravity and the loosened apparent specific gravity and the hardened apparent specific gravity of the silica particles.

Therefore, a lower particle compression ratio represents higher fluidity of the silica particles. In addition, there is a tendency that the dispersibility in the toner particles increases as fluidity increases. A method of calculating the particle compression ratio will be described later in detail.

Therefore, the specific silica particles with a particle compression ratio that is controlled to be as low as 0.20 to 0.40 have satisfactory fluidity and dispersibility in the toner particles. However, the lower limit of the particle compression ratio is set to 0.20 in terms of obtaining satisfactory adhesion to the toner particles and satisfactory cohesion while obtaining the satisfactory fluidity and the dispersibility in the toner particles.

As described above, the specific silica particles have unique characteristics, namely the high fluidity, easiness of being dispersed in the toner particles, the high cohesive force, and the high adhesion force to the toner particles. Therefore, the specific silica particles with the compression aggregation degree and the particle compression ratio within the above ranges are silica particles that have characteristics, namely the high fluidity, the high dispersibility in the toner particles, the high cohesion, and the high adhesion to the toner particles.

Next, description will be given of an estimated effect achieved when the specific silica particles are externally added to the toner particles.

First, if the specific silica particles are externally added to the toner particles, then the specific silica particles tend to adhere to the surfaces of the toner particles in a substantially uniform state due to the high fluidity and the dispersibility in the toner particles. The specific silica particles which have once adhered to the toner particle do not easily move on the toner particles and flake from the toner particles by the mechanical burden caused by the stirring in the developing unit, for example, since the specific silica particles have high adhesion to the toner particles. That is, the externally added structure does not easily change. Therefore, the fluidity of the toner particles themselves is enhanced, and also, the high fluidity tends to be maintained. As a result, the deterioration of the charge holding property is prevented even if the kneaded and pulverized toner particles with the release agent partially exposed, in which the externally added structure tends to change, is applied.

In contrast, the specific silica particles which have flaked from the toner particles due to the mechanical burden caused by the scraping at the cleaning unit and have been supplied to the tip end of the cleaning unit aggregate by a pressure from the cleaning blade due to a high cohesion and form an externally added dam with high strength. Therefore, the externally added dam further enhances the cleaning property, and the passing of the specific silica particles is prevented even if the same image is repeatedly performed and a large amount of specific silica particles flaking from the toner particles reach the same region of the cleaning unit. In addition, since the specific toner particles have the high fluidity and the high dispersibility in the toner particles as described above, a small amount of the specific toner particles enhance the fluidity of the toner particles themselves, the high fluidity tends to be maintained, and the amount of flaking silica particles is reduced. As a result, the crack on the photoreceptor due to the specific silica particles is prevented.

It is inferred that the toner according to the exemplary embodiment exhibits the excellent charge holding property in an environment at a low temperature and low humidity and prevents crack on the photoreceptor when the same image is repeatedly formed for the above reasons.

In the toner according to the exemplary embodiment, the specific silica particles further preferably have a particle dispersion degree from 90% to 100%.

Here, description will be given of meaning that the particle dispersion degree of the specific silica particles is from 90% to 100%.

The particle dispersion degree is an index indicating dispersibility of the silica particles. The index is represented by how easily the silica particles in a primary particle state are dispersed in the toner particles. Specifically, the particle dispersion degree is represented by a ratio (actually measured coverage C/calculated coverage $C_0$) between an actually measured coverage C on an adhesion target and a calculated coverage $C_0$, where $C_0$ represents the calculated coverage of the silica particles on the surfaces of the toner particles and C represents the actually measured coverage.

Therefore, a higher particle dispersion degree represents that the silica particles do not easily aggregate and tend to be dispersed in the primary particle state in the toner particles. A method of calculating the particle dispersion degree will be described later in detail.

The specific silica particles exhibit further satisfactory dispersibility in the toner particles by controlling the compression aggregation degree and the particle compression ratio within the above ranges and controlling the particle dispersion degree to be as high as 90% to 100%. In doing so, the fluidity of the toner particles themselves are further enhanced, and also, the high fluidity tends to be maintained. As a result, the specific silica particles further tend to adhere to the surfaces of the toner particles in a substantially uniform state, and the deterioration of the charge holding property tends to be prevented.

Preferable examples of the specific silica particles that have the above characteristics, namely the high fluidity, the high dispersibility in the toner particles, the high cohesion, and the high adhesion to the toner particles in the toner according to the exemplary embodiment include silica particles having a siloxane compound having a relatively large weight average molecular weight attached on the surface thereof are preferably exemplified. Specifically, silica particles having a siloxane compound having a viscosity of 1,000 cSt to 50,000 cSt attached on the surface thereof (preferably, the surface attachment amount of the siloxane compound is 0.01% by weight to 5% by weight) are preferably exemplified. These specific silica particles are obtained by a surface treatment method in which the surfaces of silica particles are treated with a siloxane compound having a viscosity of 1,000 cSt to 50,000 cSt such that the surface attachment amount is 0.01% by weight to 5% by weight.

Here, the surface attachment amount is a rate with respect to silica particles (untreated silica particles) before the surfaces of the silica particles are treated. Hereinafter, the silica particles before the surface treatment (that is, the untreated silica particles) will also be simply referred to as "silica particles".

According to the specific silica particles obtained by treating surfaces of silica particles by using the siloxane compound having a viscosity of from 1,000 cSt to 50,000 cSt such that the surface attachment amount is from 0.01% by weight to 5% by weight, the cohesion and the adhesion to the toner particles are enhanced as well as the fluidity and the dispersibility in the toner particles, and the compression aggregation degree and the particle compression ratio tend to satisfy the above requirements. In addition, the deterioration of the charge holding property and the crack on the photoreceptor tend to be prevented. This is considered to be caused by the following reasons though not clear.

If the siloxane compound having a relatively high viscosity within the above range is made to adhere to surfaces of silica particles in a small amount within the above range, then a function derived from properties of the siloxane compound on the surfaces of the silica particles appears. Although the mechanism is not clear, a release property derived from the siloxane compound tends to occur by the small amount of siloxane compound with the relatively high viscosity adhering to the silica particles within the above range, or adhesion between the silica particles is reduced by a decrease in force between the particles due to steric hindrance of the siloxane compound when the silica particles flow. Therefore, the fluidity or the silica particles and the dispersibility in the toner particles are further enhanced.

In contrast, when the silica particles are pressurized, long molecular chains of the siloxane compound on the surfaces of the silica particles get entangled, a closest packed property of the silica particles is enhanced, and aggregation between the silica particles is strengthened. The cohesive force of the silica particles caused by the long molecular chains of the siloxane compound being entangled is considered to be released if the silica particles are made to flow. In addition, the long molecular chains of the siloxane compound on the surfaces of the silica particles enhance adhesion force to the toner particles.

As described above, according to the specific silica particles obtained by causing the small amount of siloxane compound with the viscosity within the above range to adhere to the surfaces of the silica particles at an amount within the above range, the compression aggregation degree and the particle compression ratio tend to satisfy the above requirements, and the particle dispersion degree tends to satisfy the above requirement.

Hereinafter, detailed description will be given of a configuration of the toner.

Toner Particles

The toner particles contain a binder resin, for example. The toner particles may contain a coloring agent, a release agent, other additives, and the like as needed.

Binder Resin

Examples of the binder resin include vinyl resin consisting of homopolymer of monomer or copolymer of two or more kinds of monomer of styrenes (such as styrene, parachlorostyrene, or α-methylstyrene), (meth)acrylic acid esters (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate), ethylenically unsaturated nitriles (such as acrylonitrile, or methacrylonitrile), vinyl ethers (such as vinyl methyl ether, or vinyl isobutyl ether), vinyl ketones (vinyl methyl ketone, vinyl ethyl ketone, or vinyl isopropenyl ketone), or olefins (such as ethylene, propylene, or butadiene).

Examples of the binder resin also include non-vinyl resin such as epoxy resin, polyester resin, polyurethane resin, polyamide resin, cellulose resin, polyether resin, or modified resin, a mixture of such non-vinyl resin and the vinyl resin, and graft polymer obtained by polymerizing vinyl monomer in presence of the non-vinyl resin.

One kind or two or more kinds of such binder resin may be used alone or in combination.

Polyester resin is preferably used as the binder resin.

Examples of polyester resin include known polyester resin.

Examples of polyester resin include condensation polymer of polyvalent carboxylic acid and polyvalent alcohol. A commercially available polyester resin or synthesized polyester resin may be used as the polyester resin.

Examples of polyvalent carboxylic acid include aliphatic dicarboxylic acid (such as oxalic acid, malonic acid, maleic acid, fumaric acid, citraconic acid, itaconic acid, glutaconic acid, succinic acid, alkenyl succinate, adipic acid, or sebacic acid), alicyclic dicarboxylic acid (such as cyclohexane dicarboxylic acid), aromatic dicarboxylic acid (such as terephthalic acid, isophthalic acid, phtalic acid, or naphthalenedicarboxylic acid), anyhydride thereof, or lower alkyl ester (containing from 1 to 5 carbon atoms, for example) thereof. Among the examples, aromatic dicarboxylic acid, for example, is preferably used as polyvalent carboxylic acid.

As polyvalent carboxylic acid, trivalent or higher carboxylic acid with a crosslinked structure or a branched structure may be used with dicarboxylic acid. Examples of trivalent or higher carboxylic acid include trimellitic acid, pyromellitic acid, anhydride thereof, or lower alkyl ester (containing from 1 to 5 carbon atoms, for example) thereof.

One kind or two or more kinds of polyvalent carboxylic acid may be used alone or in combination.

Examples of polyvalent alcohol include aliphatic diol (such as ethylene glycol, diethylene glycol, triethylene glycol, propylene glycol, butanediol, hexanediol, or neopentyl glycol), alicyclic diol (such as cyclohexanediol, cyclohexanedimethanol, hydrogenated bisphenol A), and aromatic diol (such as ethylene oxide adduct of bisphenol A or propylene oxide adduct of bisphenol A). Among the examples, aromatic diol and alicyclic diol are preferably used, and aromatic diol is more preferably used as polyvalent alcohol.

As polyvalent alcohol, trivalent or higher alcohol with a crosslinked structure or a branched structure may be used with diol. Examples of trivalent or higher alcohol include glycerine, trimethylol propane, and pentaerythritol.

One kind or two or more kinds of polyvalent alcohol may be used alone or in combination.

The glass transition temperature (Tg) of polyester resin is preferably from 50° C. to 80° C., and more preferably from 50° C. to 65° C.

The glass transition temperature is determined by a DSC curve obtained by a differential scanning calorimetry (DSC). More specifically, the glass transition temperature is determined based on "Extrapolation glass transition onset temperature" described in how to determine glass transition temperature in JIS K 7121-1987 "Testing methods for transition temperatures of plastics".

The weight average molecular weight (Mw) of polyester resin is preferably from 5,000 to 1,000,000, and more preferably from 7,000 to 500,000.

The number average molecular weight (Mn) of polyester resin is preferably from 2,000 to 100,000.

The molecular weight distribution Mw/Mn of polyester resin is preferably from 1.5 to 100, and more preferably from 2 to 60.

The weight average molecular weight and the number average molecular weight are measured by gel permeation chromatography (GPC). The molecular weight measurement by the GPC is performed by using GPC•HLC-8120GPC manufactured by Tosoh Corporation as a measurement apparatus, a column TSKgel SuperHM-M (15 cm) manufactured by Tosoh Corporation, and a THF solvent. The weight average molecular weight and the number average molecular weight are calculated by using a molecular weight calibration curve created by a mono-dispersed polystyrene standard sample from the measurement result.

The polyester resin is obtained by a known preparing method. Specifically, the polyester resin is obtained by a method of setting a polymerization temperature to be from 180° C. to 230° C., for example, reducing a pressure in a reaction system as needed, and causing a reaction while removing water and alcohol that are generated during condensation.

In a case in which monomer of the raw materials is not dissolved or blended at the reaction temperature, a solvent with a high boiling point may be added as a solubilizer to promote the dissolution. In such a case, the polycondensation reaction is performed while evaporating the solubilizer. In a case in which monomer with low compatibility is present, it is preferable to condense the monomer with low compatibility and acid or alcohol to be polycondensed with the monomer in advance and then cause polycondensation with main components.

Preferable examples of the binder resin also include styrene (meth)acrylic resin.

The styrene (meth)acrylic resin is copolymer obtained by copolymerizing at least styrene polymerizable monomer (polymerizable monomer having a styrene skeleton) with (meth)acryl polymerizable monomer (polymerizable monomer having a (meth)acryloyl skeleton).

"(Meth)acryl" is an expression including both "acryl" and "methacryl".

Examples of the styrene polymerizable monomer include styrene, alkyl-substituted styrene (such as α-methylstyrene, 2-methylstyrene, 3-methylstyrene, 4-methylstyrene, 2-ethylstyrene, 3-ethylstyrene, or 4-ethylstyrene), halogen-substituted styrene (such as 2-chlorostyrene, 3-chlorostyrene, or 4-chlorostyrene), and vinylnaphthalene. One kind or two kinds or more of styrene polymerizable monomer may be used alone or in combination.

From among these examples, styrene is preferably used as the styrene monomer in terms of reactivity, easiness of reaction control, and availability.

Examples of (meth)acryl polymerizable monomer include (meth)acrylic acid and (meth)acrylic acid ester. Examples of (meth)acrylic acid ester include (meth)acrylic acid alkyl ester (such as methyl (meth)acrylate, ethyl (meth)acrylate, n-propyl (meth) acrylate, n-butyl (meth) acrylate, n-pentyl (meth)acrylate, n-hexyl acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth) acrylate, n-hexadecyl (meth)acrylate, n-octadecyl (meth) acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth) acrylate, isoheptyl (meth)acrylate, isooctyl (meth)acrylate, 2-ethylhexyl (meth)acrylate, cyclohexyl (meth)acrylate, or t-butylcyclohexyl (meth)acrylate), (meth)acrylic acid aryl ester (such as phenyl (meth)acrylate, biphenyl (meth)acrylate, diphenylethyl (meth)acrylate, t-butylphenyl (meth) acrylate, or terphenyl (meth)acrylate), dimethylaminoethyl (meth)acrylate, diethylaminoethyl (meth)acrylate, methoxyethyl (meth)acrylate, 2-hydroxyethyl (meth)acrylate, β-carboxyethyl (meth)acrylate, and (meth)acrylamide. One kind or two or more kinds of (meth)acrylic acid polymerizable monomer may be used alone or in combination.

A copolymerization ratio (based on weight; styrene polymerizable monomer/(meth)acryl polymerizable monomer) between the styrene polymerizable monomer and the (meth)acryl polymerizable monomer is preferably from 85/15 to 70/30, for example.

The styrene (meth)acrylic resin may have a crosslinked structure. Examples of the styrene (meth) acrylic resin having a crosslinked structure include a crosslinked product obtained by copolymerizing at least styrene polymerizable monomer, (meth)acrylic acid polymerizable monomer, and crosslinkable monomer, for example.

Examples of the crosslinkable monomer include a difunctional or higher crosslinking agent.

Examples of the difunctional crosslinking agent include divinylbenzene, divinylnaphthalene, a di(meth)acrylate compound (such as diethylene glycol di(meth)acrylate, methylene bis(meth)acrylamide, decanediol diacrylate, or glycidyl (meth)acrylate), polyester-type di(meth)acrylate, and 2-([1'-methylpropylideneamino]carboxyamino)ethyl methacrylate.

Examples of polyfunctional crosslinking agent include a tri(meth)acrylate compound (such as pentaerythritol tri (meth)acrylate, trimethylolethane tri(meth)acrylate, or trimethylolpropane tri(meth)acrylate), a tetra(meth)acrylate compound (such as tetramethylolmethane tetra(meth)acrylate, or oligoester (meth)acrylate), 2,2-bis(4-methacryloxy, polyethoxyphenyl)propane, diallylphthalate, triallyl cyanurate, triallyl isocyanurate, triallyl trimellitate, and diaryl chlorendate.

A copolymerization ratio (based on weight; crosslinkable monomer/entire monomer) of the crosslinkable monomer with respect to the entire monomer is preferably from 2/1,000 to 30/1,000.

The glass transition temperature (Tg) of the styrene (meth)acrylic resin is preferably from 50° C. to 75° C., more preferably from 55° C. to 65° C., and further preferably from 57° C. to 60° C., for example, in terms of the fixing property.

The glass transition temperature is determined by a DSC curve obtained by a differential scanning calorimetry (DSC). More specifically, the glass transition temperature is determined based on "Extrapolation glass transition onset temperature" described in how to determine glass transition temperature in JIS K 7121-1987 "Testing methods for transition temperatures of plastics".

The weight average molecular weight of styrene (meth) acrylic resin is preferably from 30,000 to 200,000, more preferably from 40,000 to 100,000, and further preferably from 50,000 to 80,000, for example, in terms of storage stability.

The weight average molecular weight is measured by gel permeation choromatography (GPC). The molecular weight measurement by the GPC is performed by using GPC•HLC-8120GPC manufactured by Tosoh Corporation as a measurement apparatus, a column TSKgel SuperHM-M (15 cm) manufactured by Tosoh Corporation, and a THF solvent. The weight average molecular weight is calculated by using a molecular weight calibration curve created by a monodispersed polystyrene standard sample from the measurement result.

The content of the binder resin is preferably from 40% by weight to 95% by weight, more preferably from 50% by weight to 90% by weight, and further preferably from 60% by weight to 35% by weight with respect to the entire toner particles, for example.

Coloring Agent

Examples of coloring agent include various pigments such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, du pont oil red, pyrazolone red, lithol red, rhodamine B lake, lake red C, pigment red, rose Bengal, aniline blue, ultramarine blue, calco oil blue, methylene blue chloride, phthalocyanine blue, pigment blue, phthalocyanine green, and malachite green oxalate or various dyes such as an acridine dye, a xanthene dye, an azo dye, a benzoquinone dye, an azine dye, an anthraquinone dye, a thioindigo dye, a dioxazine dye, a thiazine dye, an azoraethine dye, an indigo dye, a phthalocyanine dye, an aniline black dye, a polymethine dye, a triphenylmethane dye, a diphenylmethane dye, and a thiazol dye.

One kind or two or more kinds of the coloring agents may be used alone or in combination.

As the coloring agent, a surface-treated coloring agent may be used as needed, or a coloring agent may be used along with a dispersant. Multiple coloring agents may be used together.

The content of the coloring agent is preferably from 1% by weight to 30% by weight, and more preferably from 3% by weight to 15% by weight with respect to the entire toner particles, for example.

Release Agent

Examples of the release agent include hydrocarbon wax; natural wax such as carnauba wax, rice wax, or candelilla wax; synthesized or mineral-petroleum wax such as montan wax; and eater wax such as fatty acid ester or montanic acid ester. The release agent is not limited thereto.

The melting temperature of the release agent is preferably from 50° C. to 110° C., and more preferably from 60° C. to 100° C.

The melting temperature is obtained based on "Melting peak temperature" described in how to obtain a melting temperature in JIS K 7121-1987 "Testing methods for transition temperatures of plastics" from a DSC curve obtained by a differential scanning calorimetry (DSC).

The content of the release agent is preferably from 1% by weight to 20% by weight, and more preferably from 5% by weight to 15% by weight with respect to the entire toner particles, for example.

Other Additives

Examples of other additives include known additives such as a magnetic material, a charge-controlling agent, and inorganic powder. Such additives are contained in the toner particles as internal additives.

Properties of Toner Particles

The volume average particle diameter (D50v) of the toner particles is preferably from 2 μm to 10 μm, and more preferably from 4 μm to 8 μm.

The various average particle diameters and various particle diameter distribution indexes of the toner particles are measured by using a COULTER MULTISIZER II (manufactured by Beckman Coulter, Inc.) and ISOTON-II (manufactured by Beckman Coulter, Inc.) as an electrolyte.

For the measurement, 0.5 mg to 50 mg of a measurement sample is added to 2 ml of 5% aqueous solution of a surfactant (preferably sodium alkylbenzene sulfonate) as a disperant. This mixture is added to 100 ml to 150 ml of electrolyte.

The electrolyte in which the sample is suspended is subjected to dispersion processing by an ultrasonic disperser for 1 minute, and particle diameter distribution of the particles with particle diameters within a range from 2 μm to 60 μm is measured by using an aperture with an aperture diameter of 100 μm by a COULTER MULTISIZER II. The number of particles to be sampled is 50000.

Cumulative distribution of the volume and the number are depicted from the smaller diameter side, respectively, in the particle diameter range (channel) divide based on the particle diameter distribution to be measured, the particle diameter corresponding to accumulation of 16% is defined to have a volume particle diameter D16v and a number particle diameter D16p, a particle diameter corresponding to accumulation of 50% is defined to have a volume average particle diameter D50v and a cumulative number average particle diameter D50p, and a particle diameter corresponding to accumulation of 84% is defined to have a volume particle diameter D84v and a number particle diameter D84p.

The volume average particle diameter distribution index (GSDv) is calculated as $(D84v/D16v)^{1/2}$, and the number average particle diameter distribution index (GSDp) is calculated as $(D84p/D16p)^{1/2}$ by using the values.

The average circularity of the toner particles is preferably from 0.88 to 0.94, and more preferably from 0.90 to 0.93.

The average circularity of the toner is measured by FPIA-3000 manufactured by Sysmex Corporation. The apparatus employs a scheme of measuring particles dispersed in water, for example, by a flow image analysis method, and the suctioned particle suspension is introduced into a flat sheath flow cell, and a flat sample flow is formed by a sheath solution. The passing particles are captured as a stationary image by a CCD camera through an objective lens by irradiating the sample flow with strobe light. The captured particle image is subjected to two-dimensional image processing, and the circularity is calculated from a projection area and a perimeter. As for the circularity, average circularity is obtained by respectively analyzing at least 4,000 images and performing statistical processing.

$$\text{circularity}=\text{equivalent circle diameter perimeter/perimeter}=[2\times(A\pi)^{1/2}]/PM \quad \text{Equation}$$

In the above equation, A represents a projection area. and PM represents a perimeter.

For the measurement, an HPF mode (high resolution mode) is used, and dilution magnification is set to 1.0 folds. For data analysis, a circularity analysis range is set to a range from 0.40 to 1.00 for the purpose of removing measurement noise.

A part of the release agent is exposed from the surfaces of the toner particles. Specifically, an exposure rate of the release agent of the toner particles fan exposure rate of the release agent from the surfaces of the toner particles) is from 5 atom % to 40 atom %, for example. The exposure rate of the release agent is more preferably from 15 atom % to 35 atom %. In a case where the exposure rate is less than 5 atom %, dispersibiiity of silica is enhanced while a charge amount tends to steeply change in some cases. In a case where the exposure rate is greater than 40 atom %, the dispersibiiity of silica is remarkably prevented, and the charge holding property deteriorates in some cases.

Here, the exposure rate of the release agent is a value obtained by X-ray photoelectron spectroscopy (XPS). JPS-9000MX manufactured by JEOL Ltd. is used as an XPS measurement apparatus, an MgKα ray is used as an X-ray source, an accelerating voltage is set to 10 kV, and an emission current is set to 30 mA. Here, the amount of the release agent on the surface of the toner is determined by a peak separation method of a C1S spectrum. In the peak separation method, a measured C1S spectrum is separated into the respective components by using curve fitting based on a least square method. As each component spectrum as a base of the separation, the release agent used in preparing the toner particles and a C1S spectrum obtained by measuring the binder resin alone are used.

The ratio (A/B) between an amount (A) of the silica particles added to 100 parts of the toner particles and an exposure rate (B) of the release agent in the toner particles is preferably from 0.05 to 0.26.

External Additive

External additives include the specific silica particles. The external additives may include external additives other than the specific silica particles. That is, only the specific silica particles may be externally added, or the specific silica particles and other external additives maybe externally added to the toner particles.

Specific Silica Particles

Compression Aggregation Degree

Although the compression aggregation degree of the specific silica particles is from 60% to 95%, the compression aggregation degree is preferably from 70% to 95%, and more preferably from 80% to 93% in terms of obtaining satisfactory cohesion of the specific silica particles and satisfactory adhesion to the toner particles and also securing the fluidity and the dispersibility in the toner particles (particularly, in terms of the charge holding property and preventing crack on the photoreceptor).

The compression aggregation degree is calculated by the following method.

A disk-shaped mold with a diameter of 6 cm is filled with 6.0 g of specific silica particles. Then, the mold is compressed with a pressure of 5.0 t/cm$^2$ for 60 seconds by using a compression molding machine (manufactured by Maekawa Testing Machine MFG Co., Ltd.), and the compressed disk-shaped compact of the specific silica particles (hereinafter, referred to a "compact before falling") is obtained. Thereafter, the weight of the compact before falling is measured.

Then, the compact before falling is arranged on a screening mesh with an aperture of 600 μm, and the compact before falling is made to fall by a vibration classifier (manufactured by Tsutsui Scientific Instruments Co., Ltd., model number: VIBRATING MVB-1) under conditions of an amplitude of 1 mm and a vibration time of 1 minute. In doing so, the specific silica particles fall from the compact before falling through the screening mesh, and the compact of the specific silica particles remains on the screening mesh. Thereafter, the weight of the compact of the remaining specific silica particles (hereinafter, referred to as a "compact after falling") is measured.

Then, the compression aggregation degree is calculated from the ratio between the weight of the compact after falling and the weight of the compact before falling by using the following Equation (1).

$$\text{Compression aggregation degree}=(\text{weight of compact after falling/weight of compact before falling})\times 100 \quad \text{Equation (1)}$$

Particle Compression Ratio

Although the particle compression ratio of the specific silica particles is from 0.20 to 0.40, the particle compression ratio is preferably from 0.22 to 0.39, and more preferably from 0.25 to 0.36 in terms of obtaining satisfactory cohesion of the specific silica particles and satisfactory adhesion to the toner particles and also securing the fluidity and the dispersibility in the toner particles (particularly, in terms of the charge holding property and preventing crack on the photoreceptor).

The particle compression ratio is calculated by the following method.

A loosened apparent specific gravity and a hardened apparent specific gravity of the silica particles are measured by using a powder tester (manufactured by Hosokawa Micron Corporation, model number: PT-S). Then, the particle compression ratio is calculated from a ratio between a difference of the hardened apparent specific gravity and the loosened apparent specific gravity and the hardened apparent specific gravity of the silica particles by using the following Equation (2).

particle compression ratio=(hardened apparent specific gravity−loosened apparent specific gravity)/hardened apparent specific gravity Equation (2)

In addition, the "loosened apparent specific gravity" is a measured value extracted by filling a container with capacity of 100 $cm^3$ with the silica particles and weighing the silica particles, and is a bulk specific gravity in a state where the specific silica particles are made to naturally fall in the container. The "hardened apparent specific gravity" is an apparent specific gravity when degassing is performed from the state of the loosened apparent specific gravity by repeatedly applying impact to (tapping) the bottom of the container 180 times at a stroke length of 18 mm and a tapping speed of 50 times/minute, the specific silica particles are rearranged, and the container is further densely filled.

Particle Dispersion Degree

The particle dispersion degree of the specific silica particles is preferably from 90% to 100%, more preferably from 94% to 100%, and further preferably 100% in terms of obtaining further satisfactory dispersibility in the toner particles (particularly, in terms of ths charge holding property).

The particle dispersion degree is a ratio between the actually measured coverage C on the toner particles and the calculated coverage $C_0$, and is calculated by the following Equation (3).

Particle dispersion degree=actually measured coverage $C$/calculated coverage $C_0$ Equation (3)

Here, the calculated coverage $C_0$ of the specific silica particles on the surfaces of the toner particles may be calculated by the following Equation (3-1), where dt (m) represents the volume average particle diameter of the toner particles, da (m) represents the average equivalent circle diameter of the specific silica particles, ρt represents the specific gravity of the toner particles, ρa represents the specific gravity of the specific silica particles, Wt (kg) represents the weight of the toner particles, and Ha (kg) represents the amount of the specific silica particles added.

Calculated coverage $C_0=\sqrt{3}/(2\pi)\times(\rho t/\rho a)\times(dt/da)\times(Wa/Wt)\times 100$ (%) Equation (3-1)

The actually measured coverage C of the specific silica particles on the surfaces of the toner particles may be calculated by the following Equation (3-2) by measuring signal intensities of silicon atoms derived from the specific silica particles in only the toner particles, only the specific silica particles, and the toner particles covered with (adhesion) the specific silica particles, respectively, by using an X-ray photoelectron spectroscopy (XPS) ("JPS-9000MX" manufactured by JEOL Ltd.).

Actually measured coverage $C=(z-x)/(y-x)\times 100$ (%) Equation (3-2)

(In Equation (3-2), x represents the signal intensity of a silicon atom derived from the specific silica particles in only the toner particles. y represents the signal intensity of a silicon atom derived from the specific silica particles in only the specific silica particles. z represents the signal intensity of a silicon atom derived from the specific silica particles in the toner particles covered with (adhesion) the specific silica particles.)

Average Equivalent Circle Diameter

The average equivalent circle diameter of the specific silica particles is preferably from 40 nm to 200 nm, more preferably from 50 nm to 180 nm, and further preferably from 60 nm to 160 nm in terms of obtaining satisfactory fluidity of the specific silica particles, satisfactory dispersibility in the toner particles, satisfactory cohesion, and satisfactory adhesion to the toner particles (particularly, in terms of the charge holding property and preventing the crack on the photoreceptor).

As for the average equivalent circle diameter D50 of the specific silica particles, primary particles after externally adding the specific silica particles to the toner particles are observed by a scanning electron microscope (SEM) (S-4100 manufactured by Hitachi, Ltd.), an image of the primary particles are captured, the image is read by an image analyzer (LUZEXIII manufactured by Nireco Corporation), an area of each particle is measured by image analysis of the primary particles, and the equivalent circle diameter is calculated from the value of area. The 50% diameter (D50) of the obtained cumulative frequency of the equivalent circle diameter based on the volume is regarded as the average equivalent circle diameter D50 of the specific silica particles. The magnification of the electron microscope is set such that from 10 to 50 specific silica particles are viewed in a single field of view, and the equivalent circle diameter of the primary particles is obtained collectively from observation of multiple fields of view.

Average Circularity

Although the shape of the specific silica particles may be any of a spherical shape and an irregular shape, the average circularity of the specific silica particles is preferably from 0.35 to 0,93, more preferably from 0.90 to 0.98, and further preferably from 0. 93 to 0.98 in terms of obtaining satisfactory fluidity of the specific silica particles, satisfactory dispersibility in the toner particles, satisfactory cohesion, and satisfactory adhesion to the toner particles (particularly, in terms of the charge holding property and preventing crack on the photoreceptor).

The average circularity of the specific silica particles are measured by the following method.

First, the circularity of the specific silica particles is obtained as "100/SF2" calculated by the following equation in planar image analysis of the primary particles obtained by observing the primary particles after externally adding the silica particles to the toner particles by an SEM apparatus.

circularity $(100/SF2)=4\pi\times(A/I^2)$ Equation

In the equation, I represents a perimeter of the primary particles on the image, and A represents a projection area of the primary particles.

The average circularity of the specific silica particles is obtained as 50% circularity of the cumulative frequency of circularity of 100 primary particles obtained in the planar image analysis.

Here, a method of measuring the respective properties (the compression aggregation degree, the particle compression ratio, the particle dispersion degree, and the average circularity) of the specific silica particles in the toner will be described.

First, the external additive (specific silica particles) are separated from the toner as follows. The external additive may be separated from the toner particles by dispersing the toner in methanol, stirring the mixture, and treating the mixture with an ultrasonic bath. How easily the external additive may be separated depends on the particle diameter and the specific gravity of the external additive, and it is possible to separate only the specific silica particles by setting an ultrasonic processing condition to be weak since the specific silica particles with a large diameter are easily separated. Next, the external additive of particles with an intermediate diameter and a small diameter may be flaked from the surfaces of the toner particles by changing the ultrasonic processing condition to be strong. The specific silica particles may be extracted by performing this operation every time, precipitating the toner particles by centrifugation, collecting only methanol in which the external additive is dispersed, and then volatilizing methanol. It is necessary to adjust the ultrasonic processing condition in accordance with the particle diameter of the specific silica particles. Then, the separated specific silica particles are used to measure the respective properties.

Hereinafter, detailed description will be given of a configuration of the specific silica particles.

Specific Silica Particles

The specific silica particles are particles that contain silica (that is $SiO_2$) as a main component, and may be crystalline particles or amorphous particles. The specific silica particles may be particles prepared by using a silicon compound, such as water glass or alkoxysilane, as a raw material or may be particles obtained by pulverizing quartz.

Specific examples of the specific silica particles include silica particles prepared by a sol-gel method (hereinafter, referred to as "sol-gel silica particles"), water-based colloidal silica particles, alcoholic silica particles, fumed silica particles obtained by a gas-phase method, and melted silica particles. From among these examples, the sol-gel silica particles are preferably used.

Surface Treatment

The surfaces of the specific silica particles are preferably treated with a siloxane compound to set the compression aggregation degree, the particle compression ratio, and the particle dispersion degree within the specific ranges.

As a method of the surface treatment, the surfaces of the silica particles are preferably treated in supercritical carbon dioxide by using supercritical carbon dioxide. The method of the surface treatment will be described later.

Siloxane compound

The siloxane compound is not particularly limited as long as the siloxane compound has a siloxane skeleton in a molecule structure.

Examples of the siloxane compound include silicone oil and silicone resin. From among these examples, silicone oil is preferably used in terms of treating the surfaces of the silica particles in a substantially uniform state.

Examples of the silicone oil include dimethyl silicone oil, methyl hydrogen silicone oil, methylphenyl silicone oil, amino-modified silicone oil, epoxy-modified silicone oil, carboxyl-modified silicone oil, carbinol-modified silicone oil, methacryl-modified silicone oil, mercapto-modified silicone oil, phenol-modified silicone oil, polyether-modified silicone oil, methylstyryl-modified silicone oil, alkyl-modified silicone oil, higher fatty acid ester-modified silicone oil, higher fatty acid amide-modified silicone oil, and fluorine-modified silicone oil. From among these examples, dimethyl silicone oil, methyl hydrogen silicone oil, and amino-modified silicone oil are preferably used.

One kind or two or more kinds of the siloxane compounds may be used alone or in combination.

Viscosity

The viscosity (kinematic viscosity) of the siloxane compound is preferably from 1,000 cSt to 50,000 cSt, more preferably from 2,000 cSt to 30,000 cSt, and further preferably from 3,000 cSt to 10,000 cSt in terms of obtaining satisfactory fluidity of the specific silica particles, satisfactory dispersibility in the toner particles, satisfactory cohesion, and satisfactory adhesion to the toner particles (particularly, in terms of the charge holding property and preventing crack on the photoreceptor).

The viscosity of the siloxane compound is obtained by the following procedure. Toluene is added to the specific silica particles and is dispersed by an ultrasonic disperser for 30 minutes. Thereafter, supernatant is collected. At this time, a toluene solution of the siloxane compound with a concentration of 1 g/100 ml is obtained. At this time, specific viscosity $[\eta_{sp}]$ (25° C.) is obtained by the following Equation (A).

$$\eta_{sp}=(\eta/\eta_0)-1 \quad \text{Equation (A)}$$

($\eta_0$: viscosity of toluene, $\eta$: viscosity of solution)

Next, the specific viscosity $[\eta_{sp}]$ is substituted into a relational expression of Huggins represented as the following Equation (B), and intrinsic viscosity $[\eta]$ is obtained.

$$\eta_{sp}=[\eta]+K'[\eta]^2 \quad \text{Equation (B)}$$

(K': constant of Huggins, K'=0.3 (when $[\eta]$=1 to 3 is adapted))

Next, the intrinsic viscosity $[\eta]$ is substituted into the equation of A. Kolorlov represented as the following Equation (C), and a molecular weight M is obtained.

$$[\eta]=0.215\times10^{-4}M^{0.05} \quad \text{Equation (C)}$$

The molecular weight M is substituted into the equation of A. J. Barry represented as the following Equation (D), and viscosity $[\eta]$ of siloxane is obtained.

$$\log \eta=1.00+0.0123M^{0.5} \quad \text{Equation (D)}$$

Surface Attachment Amount

The surface attachment amount of the siloxane compound to the surfaces of the specific silica particles is preferably from 0.01% by weight to 5% by weight, more preferably from 0.05% by weight to 3% by weight, and further preferably from 0.10% by weight to 2% by weight with respect to the silica particles (the silica particles before the surface treatment) in terms of obtaining satisfactory fluidity of the specific silica particles, satisfactory dispersibility in the toner particles, satisfactory cohesion, and satisfactory adhesion to the toner particles (particularly, in terms of the charge holding property and preventing crack on the photoreceptor).

The surface attachment amount is measured by the following method.

100 mg of specific silica particles are dispersed in 1 mL of chloroform, 1 μL of N,N-dimethylformamide (DMF) as an internal standard solution is added, the mixture is then subjected to ultrasonic processing for 30 minutes by an ultrasonic washing machine, and the siloxane compound is extracted to a chloroform solvent. Thereafter, hydrogen nuclear spectrum measurement is performed by using a JNM-AL400 nuclear magnetic resonator (manufactured by JEOL Ltd.), and the amount of the siloxane compound is obtained from a ratio of a siloxane compound-derived peak area with respect to a DMF-derived peak area. Then, the surface attachment amount is obtained from the amount of the siloxane compound.

Here, the surfaces of the specific silica particles are preferably treated with the siloxane compound having a viscosity of from 1,000 cSt to 50,000 cSt, and the surface attachment amount of the siloxane compound to the surfaces of the silica particles is preferably from 0.01% by weight to 5% by weight.

By satisfying the above requirements, the specific silica particles with satisfactory fluidity and satisfactory dispersibility in the toner particles and also with an enhanced cohesion and enhanced adhesion to the toner particles tend to be obtained.

External Additive Amount

The external additive amount (content) of the specific silica particles is preferably from 0.05% by weight to 5.0% by weight, more preferably from 0.2% by weight to 4.5% by weight, and further preferably from 0.3% by weight to 3.0% by weight with respect to the toner particles in terms of the charge holding property of the toner and preventing crack on the photoreceptor.

Preparing Method of Specific Silica Particles

The specific silica particles are obtained by treating the surfaces of the silica particles with the siloxane compound having a viscosity of from 1,000 cSt to 50,000 cSt such that the surface attachment amount to the silica particles is from 0.01% by weight to 5% by weight.

According to the preparing method of the specific silica particles, silica particles with satisfactory fluidity and satisfactory dispersibility in the toner particles and also with an enhanced cohesion and enhanced adhesion to the toner particles are obtained.

Examples of the surface treatment method include a method of treating the surfaces of the silica particles with the siloxane compound in supercritical carbon dioxide; and a method of treating the surfaces of the silica particles with the siloxane compound in the atmospheric air.

Specific examples of the surface treatment method include: a method of using supercritical carbon dioxide to dissolve the siloxane compound therein and cause the siloxane compound to adhere to the surfaces of the silica particles; a method of applying (spraying or coating, for example) a solution that contains the siloxane compound and a solvent, for dissolving the siloxane compound therein to the surfaces of the silica particles in the atmospheric air and causing the siloxane compound to adhere to the surfaces of the silica particles; and a method of adding a solution containing the siloxane compound and a solvent for dissolving the siloxane compound therein to a silica particle dispersion and holding the mixture in the atmospheric air, and then drying the mixture solution of the silica particle dispersion and the solution.

From among these examples, the method of using supercritical carbon dioxide to cause the siloxane compound to adhere to the surfaces of the silica particles is preferably used as the surface treatment method.

If the surface treatment is performed in supercritical carbon dioxide, then a state where the siloxane compound is dissolved in supercritical carbon dioxide is obtained. It is considered that since supercritical carbon dioxide has a low surface tension, the siloxane compound in the state of being dissolved in supercritical carbon dioxide tend to be diffused and reach deep portions of pores on the surfaces of the silica particles along with supercritical carbon dioxide and the surface treatment with the siloxane compound affects not only the surfaces of the silica particles but also the deep portions of the pores.

Therefore, it is considered that the silica particles surface-treated with the siloxane compound in supercritical carbon dioxide become silica particles surface-treated with the siloxane compound in substantially uniform state (such as a state where a surface treated layer is formed in a thin film shape).

In the preparing method of the specific silica particles, surface treatment for applying hydrophobicity to the surfaces of the silica particles may be performed by using a hydrophobizing agent along with the siloxane compound in supercritical carbon dioxide.

In such a case, it is considered that a state where the hydrophobizing agent is dissolved along with the siloxane compound in supercritical carbon dioxide is obtained, the siloxane compound and the hydrophobizing agent in the state being dissolved in supercritical carbon dioxide tend to be diffused and reach the deep portions of the pores on the surfaces of the silica particles, along with supercritical carbon dioxide, and the surface treatment with the siloxane compound and the hydrophobizing agent affects not only the surfaces of the silica particles but also the deep portions of the pores.

As a result, the silica particles surface-treated with the siloxane compound and the hydrophobizing agent in supercritical carbon dioxide have substantially uniform surfaces treated with the siloxane compound and the hydrophobizing agent, and also, high hydrophibicity tends to be applied thereto.

In the preparing method of the specific silica particles, supercritical carbon dioxide may be used in other preparation processes (such as a solvent removing process) of the silica particles.

Examples of the preparing method of the specific silica particles using supercritical carbon dioxide in other preparation processes include a preparing method of the silica particles including a process for preparing a silica particle dispersion that contains silica particles and a solvent containing alcohol and water by a sol-gel method (hereinafter, referred to as a "dispersion preparation process", a process for distributing supercritical carbon dioxide and removing the solvent from the silica particle dispersion (hereinafter, referred to as a "solvent removing process"), and a process for treating surfaces of the silica particles after removing the solvent with the siloxane compound in supercritical carbon dioxide (hereinafter, referred to as a "surface treatment process").

If the solvent is removed from the silica particle dispersion by using supercritical carbon dioxide, formation of coarse particles tends to be prevented.

This is considered to be 1) because in a case of removing the solvent in the silica particle dispersion, a characteristic of supercritical carbon dioxide that "surface tension does not work" enables the removal of the solvent without causing aggregation between the particles due to liquid bridging force during the removal of the solvent, and 2) because a characteristic that supercritical carbon dioxide "is carbon dioxide in a state under a temperature and a pressure of equal to or greater than critical points and has both a gas diffusing property and a liquid dissolving property" enables effective contact to supercritical carbon dioxide at a relatively low temperature (equal to or lower than 250° C., for example) and dissolving of the solvent, and thus enables the removal of the solvent in the silica particle dispersion without forming coarse particles such as secondary aggregates due to condensation of a silanol group by removing supercritical carbon dioxide with the solvent dissolved therein, though not clear.

Here, although the solvent removing process and the surface treatment process may be individually performed, it is preferable that the solvent removing process and the surface treatment process are successively performed (that is, the respective processes are performed in a state of being not opened to the atmospheric pressure). If the respective processes are successively performed, there is no opportunity that the silica particles adsorb humidity after the solvent removing process, and the surface treatment process may be performed in a state where excessive humidity adsorption by the silica particles is prevented. In doing so, it is not necessary to use a large amount of siloxane compound and to perform the solvent removing process and the surface treatment process at a high temperature by performing excessive heating. As a result, formation of coarse particles tend to be prevented more effectively.

Hereinafter, detailed description will be given of the respective processes for details of the preparing method of the specific silica particles.

The preparing method of the specific silica particles is not limited thereto, and 1) a configuration in which supercritical carbon dioxide is used only in the surface treatment process or 2) a configuration in which the respective processes are individually performed, for example, may be employed.

Hereinafter, detailed description will be given of the respective processes.

Dispersion Preparation Process

In a dispersion preparation process, a silica particle dispersion containing silica particles and a solvent that contains alcohol and water is prepared, for example.

Specifically, the silica particle dispersion is prepared by a wet method (such as a sol-gel method), for example, and is prepared in the dispersion preparation process. In particular, the silica particle dispersion is preferably prepared by a sol-gel method as a wet method, specifically by causing a reaction (a hydrolysis reaction or a condensation reaction) of tetraalkoxysilane in a solvent of alcohol and water in presence of an alkali catalyst to prepare silica particles.

The preferable range of the average equivalent circle diameter and the preferable range of the average circularity of the silica particles are as described above.

In the case of obtaining the silica particles by the wet method, for example, in the dispersion preparation process, a dispersion (silica particle dispersion) in which the silica particles are dispersed in the solvent is obtained.

Here, the weight ratio of water with respect to alcohol in the prepared silica particle dispersion is preferably from 0.05 to 1.0, more preferably from 0.07 to 0.5, and further preferably from 0.1 to 0.3 at the timing of moving on to the solvent removing process.

If the weight ratio of water with respect to alcohol in the silica particle dispersion is set within the above range, the amount of coarse silica particles formed after the surface treatment is small, and silica particles with satisfactory electric resistance tend to be obtained.

If the weight ratio of water with respect to alcohol is less than 0.05, condensation of silanol groups on the surfaces of the silica particles during removal of the solvent is reduced in the solvent removing process. Therefore, the amount of humidity adsorbed by the surfaces of the silica particles after the removal of the solvent increases, and the electric resistance of the silica particles after the surface treatment becomes excessively low in some cases. If the weight ratio of water is greater than 1.0, a large amount of water remains near the end of the removal of the solvent from the silica particle dispersion in the solvent removing process, aggregation between the silica particles due to liquid bridging force tends to occur, and coarse particles are present after the surface treatment in some cases.

The weight ratio of water with respect to the silica particles in the prepared silica particle dispersion is preferably from 0.02 to 3, more preferably from 0.05 to 1, and further preferably from 0.1 to 0.5, for example, at the timing of moving on to the solvent removing process.

If the weight ratio of water with respect to the silica particles in the silica particle dispersion is set within the above range, the amount of coarse silica particles formed is small, and silica particles with satisfactory electric resistance tend to be obtained.

If the weight ratio of water with respect to the silica particles is less than 0.02, condensation of silanol groups on the surface of the silica particles during the removal of the solvent is remarkably reduced in the solvent removing process. Therefore, the amount of humidity adsorbed by the surfaces of the silica particles after the removal of the solvent increases, and the electric resistance of the silica particles becomes excessively low in some cases.

If the weight ratio of water is greater than 3, a large amount of water remains near the end of the removal of the solvent from the silica particle dispersion in the solvent removing process, and aggregation between the silica particles due to the liquid bridging force tends to occur.

The weight ratio of the silica particles with respect to the silica particle dispersion in the prepared silica particle dispersion is preferably from 0.05 to 0.7, more preferably from 0.2 to 0.65, and further preferably from 0.3 to 0.6 at the timing of moving on to the solvent removing process.

If the weight ratio of the silica particles with respect to the silica particle dispersion is less than 0.05, the amount of supercritical carbon dioxide used in the solvent removing process increases, and productivity deteriorates in some cases.

If the weight ratio of the silica particles with respect to the silica particle dispersion is greater than 0.7, the distances between silica particles decreases in the silica particle dispersion, and course silica particles due to aggregation and gelatinization tend to occur in some cases.

Solvent Removing Process

The solvent removing process is a process for distributing supercritical carbon dioxide and removing the solvent from the silica particle dispersion, for example.

That is, the solvent removing process is a process of removing the solvent by distributing supercritical carbon dioxide and bringing supercritical carbon dioxide into contact with the silica particle dispersion.

Specifically, the silica particle dispersion is put into a sealed reactor, for example, in the solvent removing process. Thereafter, liquefied carbon dioxide is added to the sealed reactor, the mixture is heated, the pressure in the reactor is boosted by a high-pressure pump, and carbon dioxide is brought into supercritical state. Then, supercritical carbon dioxide is introduced into the sealed reactor, is discharged therefrom, and is thus distributed in the sealed reactor, namely in the silica particle dispersion.

In doing so, supercritical carbon dioxide is discharged to the outside of the silica particle dispersion (outside of the sealed reactor) while dissolved in the solvent (alcohol and water), and the solvent is removed.

Here, supercritical carbon dioxide is carbon dioxide in a state under a temperature and a pressure of equal to or greater than critical points and has both a gas diffusing property and a liquid dissolving property.

A temperature condition, namely the temperature of supercritical carbon dioxide during the removal of the solvent is preferably from 31° C. to 350° C., more preferably from 60° C. to 300° C., and further preferably from 80° C. to 250° C., for example.

If the temperature is less than the above range, it becomes difficult for the solvent to be dissolved in supercritical carbon dioxide. Therefore, it becomes difficult to remove the solvent in some cases. In addition, it is considered that coarse particles tend to be formed due to the liquid bridging force of the solvent and supercritical carbon dioxide. In contrast, it is considered that if the temperature is greater than the above range, then coarse particles such as secondary aggregates tend to be formed due to condensation of silanol groups on the surfaces of the silica particles.

A pressure condition, namely a pressure of supercritical carbon dioxide during the removal of the solvent is preferably from 7.38 MPa to 40 MPa, more preferably from 10 MPa to 35 MPa, and further preferably from 15 MPa to 25 MPa, for example.

If the pressure is less than the above range, it tends to be difficult for the solvent to be dissolved in supercritical carbon dioxide. In contrast, if the pressure is greater than the above range, equipment tends to be expensive.

The amount of supercritical carbon dioxide to be introduced to and discharged from the sealed reactor is preferably from 15.4 L/minute/$m^3$ to 1540 L/minute/$m^3$, and more preferably from 77 L/minute/$m^3$ to 770 L/minute/$m^3$.

If the introduced and discharged amount is less than 15.4 L/minute/$m^3$, it takes long time to remove the solvent. Therefore, the productivity tends to deteriorate.

In contrast, if the introduced and discharged amount is greater than 1540 L/minute/$m^3$, then short pass of supercritical carbon dioxide occurs, contact time of the silica particle dispersion is reduced, and it tends to become difficult to efficiently remove the solvent.

Surface Treatment Process

The surface treatment process is a process of treating the surfaces of the silica particles with the siloxane compound in supercritical carbon dioxide, which follows the solvent removing process, for example.

That is, in the surface treatment process, the surfaces of the silica particles are treated with the siloxane compound in supercritical carbon dioxide without exposure to the atmospheric air before moving on from the solvent removing process, for example.

Specifically, in the surface treatment process, the temperature and the pressure in the sealed reactor are adjusted after the introduction and the discharge of the supercritical carbon dioxide to and from the sealed reactor in the solvent removing process is stopped, for example, and the siloxane compound is put into the silica particles at a predetermined rate in the sealed reactor in presence of supercritical carbon dioxide. Then, a reaction of the siloxane compound is caused while the state is maintained, namely in supercritical carbon dioxide, and the surfaces of the silica particles are treated.

Here, it is only necessary the reaction of the siloxane compound is caused in supercritical carbon dioxide (namely, in an atmosphere of supercritical carbon dioxide) in the surface treatment process, and the surface treatment may be performed while supercritical carbon dioxide is distributed (that is, while supercritical carbon dioxide is introduced into and discharged from the sealed reactor), or the surface treatment may be performed without distributing supercritical carbon dioxide.

In the surface treatment process, the amount of silica particles with respect to an inner volume of the reactor (namely, the amount of silica particles fed) is preferably from 30 g/L to 600 g/L, more preferably from 50 g/L to 500 g/L, and further preferably from 80 g/L to 400 g/L, for example.

If the amount is less than the above range, concentration of the siloxane compound with respect to supercritical carbon dioxide decreases, a rate of contact with the silica surfaces decreases, and the reaction tends not to advance in some cases. In contrast, if the amount is greater than the above range, the concentration of the siloxane compound with respect to supercritical carbon dioxide increases, the siloxane compound is not completely dissolved in supercritical carbon dioxide, which brings about a dispersion defect, and coarse aggregates tend to be formed.

The density of supercritical carbon dioxide is preferably from 0.10 g/ml to 0.80 g/ml, preferably from 0.10 g/ml to 0.60 g/ml, and further preferably from 0.2 g/ml to 0.50 g/ml, for example.

If the density is less than the above range, the solubility of the siloxane compound in supercritical carbon dioxide decreases, and aggregates tend to be formed. In contrast, if the density is greater than the above range, the diffusing property in silica pores deteriorates. Therefore, there is a case in which the surface treatment is insufficiently performed. It is preferable to perform the surface treatment within the above density range especially on sol-gel silica particles that contain a large number of silanol groups.

The density of supercritical carbon dioxide is adjusted by a temperature, a pressure, and the like.

Specific examples of the siloxane compound are as described above. Also, the preferable range of the viscosity of the siloxane compound is as described above.

If silicone oil is applied from among the examples of the siloxane compound, the silicone oil tends to adhere to the surfaces of the silica particles in a substantially uniform state, and the fluidity, the dispersibility, and an operability of the silica particles tend to be enhanced.

The amount of siloxane compound used is preferably from 0.05% by weight to 3% by weight, more preferably from 0.1% by weight to 2% by weight, and further preferably from 0.15% by weight to 1.5% by weight with respect to the silica particles, for example, in terms of easily controlling the surface attachment amount with respect to the silica particles within the range from 0.01% by weight to 5% by weight.

The siloxane compound may be used alone, or a solution mixed with a solvent in which the siloxane compound is easily dissolved may be used. Examples of the solvent include toluene, methyl ethyl ketone, and methyl isobutyl ketone.

In the surface treatment process, the surfaces of the silica particles may be treated with a mixture containing the siloxane compound and a hydrophobizing agent.

Examples of the hydrophobizing agent include a silane hydrophobizing agent. Examples of the silane hydrophobizing agent include known silicon compounds having alkyl groups (such as a methyl group, an ethyl group, a propyl group, or a butyl group), and specific examples thereof include a silazane compound (a silane compound such as methyltrimethoxysinale, dimethyldimethoxysilane, trimethylchloresilane, or trimethylmethoxysilane, hexamethyldisilazane, or tetramethyldisilazae). One kind or multiple kinds of the hydrophobizing agents may be used.

From among the silane hydrophobizing agents, a silicon compound having a trimethyl group, such as trimethylmethoxysilane or hexamethyldisilazane (HMDS), particularly, hexamethyldisilazane (HMDS) is preferably used.

The amount of silane hydrophobizing agent used is not particularly limited, the amount is preferably from 1% by weight to 100% by weight, more preferably from 3% by weight to 80% by weight, and further preferably from 5% by weight to 50% by weight with respect to the silica particles, for example.

The silane hydrophobizing agent may be used alone, or the hydrophobizing agent may be used as a solution mixed with a solvent in which the silane hydrophobizing agent is easily dissolved. Examples of the solvent include toluene, methyl ethyl ketone, and methyl isobutyl ketone.

A temperature condition, namely the temperature of supercritical carbon dioxide in the surface treatment is preferably from 80° C. to 300° C., more preferably from 100° C. to 250° C., and further preferably from 120° C. to 200° C.

If the temperature is less than the above range, surface treatment ability of the siloxane compound deteriorates in some cases. In contrast, if the temperature is greater than the above range, a condensation reaction between silanol groups in the silica particles advances, and particle aggregation occurs in some cases. The surface treatment is preferably performed within the above temperature range on sol-gel silica particles that contain a large number of silane groups, in particular.

Although any pressure condition, namely any pressure of supercritical carbon dioxide in the surface treatment may be set as long as the above density is satisfied, the pressure is preferably from 8 MPa to 30 MPa, more preferably from 10 MPa to 25 MPa, and further preferably from 15 MPa to 20 MPa, for example.

The specific silica particles are obtained by the respective processes described above.

Other External Additives

Examples of other external additives include inorganic particles. Examples of the inorganic particles include $SiO_2$ (except for the specific silica particles), $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

It is preferable that the surfaces of the inorganic particles as other external additive are treated with a hydrophobizing agent. The treatment with the hydrophobizing agent is performed by dipping the inorganic particles in a hydrophobizing agent, for example. Although the hydrophobizing agent is not particularly limited, examples thereof include a silane coupling agent, silicone oil, a titanate coupling agent, and an aluminum coupling agent. One kind or two or more kinds of the hydrophobizing agents may be used alone or in combination.

The amount of the hydrophobizing agent is typically from 1 part by weight to 10 parts by weight with respect to 100 parts by weight of the inorganic particles, for example.

Examples of other external additive also include resin particles (resin particles of polystyrene, polymethyl methacrylate (PMMA), melamine resin, or the like) and a cleaning aid (metal salt of higher fatty acid, representative examples of which include zinc stearate, particles of fluorine high-molecular-weight material).

The amount of the external additive externally added is preferably from 0.2% by weight to 6.0% by weight, and more preferably from 0.5% by weight to 4.5% by weight with respect to the amount of the toner particles, for example.

Preparing Method of Toner

Next, description will be given of a preparing method of the toner according to the exemplary embodiment.

The toner according to the exemplary embodiment is obtained by preparing the toner particles and then externally adding the external additives to the toner particles.

The toner particles are kneaded and pulverized toner particles obtained by a kneading and pulverizing method.

Next, description will be given of the kneading and pulverizing method.

The kneading and pulverizing method is a method of obtaining toner particles by melting and kneading toner particle forming materials such as a binder resin and a release agent and then pulverizing the molten-kneaded substance. Specifically, the kneading and pulverizing method is a method of obtaining toner particles by a kneading process of melting and kneading the toner particle forming materials such as a binder resin and a release agent, a cooling process of cooing the molten-kneaded substance, a pulverizing process of pulverizing the kneaded substance after the cooling, and a classification process of classifying the pulverized substance, for example.

Hereinafter, detailed description will be given of the kneading and pulverizing method.

Kneading Process

In the kneading process, the toner forming materials including the binder resin and the release agent are kneaded. Examples of a kneader used in the kneading process include a single-screw extruder and a twin-screw extruder. Although description will be given below of a kneader including a sending screw portion and two kneading portions as an example of the kneader with reference to the drawing, the kneader is not limited thereto.

Figure 3:
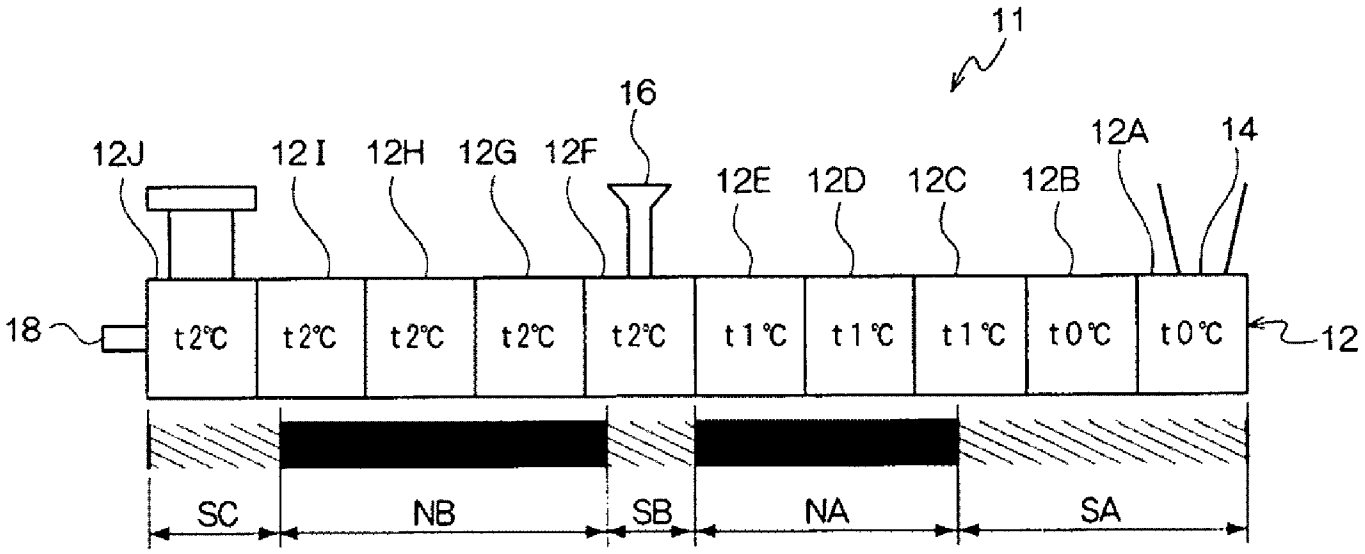
FIG. 3 is a configuration diagram schematically illustrating an example of a screw extruder used in a kneading process for preparing toner particles.

FIG. 3 is a configuration diagram schematically illustrating an example of a screw extruder used in the kneading process for preparing the toner particles.

As illustrated in FIG. 3, the screw extruder 11 includes a barrel 12 provided with a screw (not shown), an injection port 14 for injecting the toner forming materials to the barrel 12 as raw materials of the toner, a liquid addition port 16 for adding a water medium to the toner forming materials in the barrel 12, and a discharge port 18 for discharging the kneaded substance formed by kneading the toner forming materials in the barrel 12.

The barrel 12 is divided into a sending screw portion SA for sending the toner forming material injected from the injecting port 14 to a kneading portion NA, a kneading portion NA for melting and kneading the toner forming materials in a first kneading process, a sending screw portion SB for sending the toner forming materials melted and kneaded in the kneading portion NA to a kneading portion NB, the kneading portion NB for melting and kneading the toner forming materials in a second kneading process to form a kneaded substance, and a sending screw portion SC for sending the formed kneaded substance to the discharge port 18 in an order from the position closest to the injection port 14.

Different temperature control units (not shown) are provided for the respective blocks inside the barrel 12. That is, the barrel 12 is configured such that blocks 12A to 12J may be controlled to have the respectively different temperatures. FIG. 3 illustrates a state where the temperature in blocks 12A and 12B is controlled to t0° C., the temperature in blocks 12C to 12E is controlled to t1° C., and the temperature from blocks 12F to 12J is controlled to t2° C., respectively. Therefore, the toner forming materials in the kneading portion NA is heated at t1° C., and the toner forming materials in the kneading portion NB is heated at t2° C.

If the toner forming materials containing the binder resin, the release agent, and the like are supplied from the injection port 14 to the barrel 12, then the toner forming materials are sent to the kneading portion NA by the sending screw portion SA. Since the temperature of the block 12C is set to t1° C. at this time, the toner forming materials are heated and are brought into the kneading portion NA in a melted state. Then, the toner forming materials are melted and kneaded at the temperature t1° C. in the kneading portion NA since the temperature of the blocks 12D and 12E is also set to t1° C. The binder resin and the release agent are brought into the melted state in the kneading portion NA and are sheared by a screw.

Next, the toner forming materials after being kneaded in the kneading portion NA is sent to the kneading portion NB by the sending screw portion SB.

Then, a water medium is added to the toner forming materials in the sending screw portion SB by injecting the water medium from the liquid addition port 16 to the barrel 12. Although FIG. 3 illustrates a configuration in which the water medium is injected in the sending screw portion SB, the configuration is not limited thereto, and the water medium may be injected in the kneading portion NB or may be poured in both the sending screw portion SB and the kneading portion NB. That is, the position at which the water medium is poured and the location to which the water medium is poured are selected as needed.

By pouring the water medium from the liquid addition port 16 to the barrel 12 as described above, the toner forming materials and the water medium are mixed in the barrel 12, the toner forming materials are cooled by evaporative latent heat of the water medium, and the temperature of the toner forming materials is maintained.

Finally, the kneaded substance formed by being melted and kneaded by the kneading portion NB is sent to the discharge port 18 by the sending screw portion SC, and is discharged from the discharge port 18.

The kneading process using the screw extruder 11 as illustrated in FIG. 3 is performed as described above.

Cooling Process

The cooling process is a process of cooling the kneaded substance formed by the kneading process. In the cooling process, the cooling is preferably performed to a temperature of equal to or lower than 40° C. at an average temperature lowering speed of equal to or greater than 4° C./sec from the temperature of the kneaded substance at the timing of the completion of the kneading process. In a case where the cooling speed of the kneaded substance is low, fine mixtures dispersed in the binder resin is recrystallized in the kneading process, and the dispersion diameter increases in some cases. It is preferable that the cooling is quickly performed at the above average temperature lowering speed since the dispersed state immediately after the completion of the kneading process is maintained as it is. The above temperature lowering speed is an average value of speeds at which the temperature is lowered from the temperature of the kneaded substance at the timing of the completion of the kneading process (t2° C. in the case of using the screw extruder 11 in FIG. 3, for example) to 40° C.

Specific examples of a cooling method in the cooling process include a method of using a mill roller, a nipping-type cooling belt, and the like through which cooling water or brine is circulated. In a case of performing the cooling by the method, the cooling speed is determined in accordance with a speed of the mill roller, a flow amount of the brine, a supply amount of the kneaded substance, a slap thickness at the time of rolling the kneaded substance, and the like. The slab thickness is preferably as thin as 1 mm to 3 mm.

Pulverizing Process

The kneaded substance cooled in the cooling process is then pulverized in the pulverizing process, and particles are formed. In the pulverizing process, a mechanical pulverizer or a jet-type pulverizer, for example, is used.

Classification Process

The pulverized substances (particles) obtained by the pulverizing process may be subjected to classification in the classification process as needed in order to obtain toner particles with a volume average particle diameter within the targeted range. In the classification process, a centrifugal classifier, an inertial classifier, or the like, which is used in the related art, is used to remove fine particles (particles with smaller particle diameters than the targeted range) and coarse particles (particles with large particle diameters than the targeted range).

The toner particles are obtained by the above processes.

Then, the toner according to the exemplary embodiment is prepared by adding an external additive to the obtained toner particles in the dried state and mixing the external additive and the toner particles, for example. The mixing is preferably performed by a V BLENDER, a HENSCHEL MIXER, a LOEDIGE MIXER, or the like. Furthermore, coarse particles of the toner may be removed by using a vibration classifier, a wind classifier, or the like as needed.

Electrostatic Charge Image Developer

The electrostatic charge image developer according to the exemplary embodiment contains at least the toner according to the exemplary embodiment.

The electrostatic charge image developer according to the exemplary embodiment may be a single-component developer that contains only the toner according to the exemplary embodiment or may be a two-component developer in which the toner is mixed with a carrier.

The carrier is not particularly limited, and known carriers are exemplified. Examples of the carrier include a covered carrier in which the surfaces of cores made of magnetic particles are covered with covering resin; a magnetic particle dispersed-type carrier in which magnetic particles are dispersed and blended in matrix resin; and resin impregnation-type carrier in which porous magnetic particles are impregnated with resin.

The magnetic particle dispersed-type carrier and the resin impregnation-type carrier may be carrier in which constituent particles of the carriers form cores and the surfaces thereof are covered with the covering resin.

Examples of the magnetic particles include magnetic metal such as iron, nickel, or cobalt, and magnetic oxide such as ferrite and magnetite.

Examples of the covering resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid ester copolymer, or straight silicone resin or modified substances thereof that contain a organosiloxane bond, fluorine resin, polyester, polycarbonate, phenol resin, and epoxy resin.

The covering resin and the matrix resin may contain another additive such as conductive particles.

Examples of the conductive particles include: metal such as gold, silver, or copper; and particles of carbon black, titanium oxide, zinc oxide, tin oxide, barium sulfate, aluminum borate, potassium titanate, or the like.

Here, for covering the surfaces of the cores with the covering resin, a covering method using a solution for forming a covering layer that is obtained by dissolving the covering resin, and if necessary, various additives in an appropriate solvent is exemplified. The solvent is not particularly limited and may be selected in consideration of the covering resin used, application aptitudes, and the like.

Specific examples of the resin covering method include a dipping method of dipping the cores in the solution for forming the covering layer, a spray method of spraying the solution for forming the covering layer to the surfaces of the cores, a fluidized bed method of spraying the solution for forming the covering layer in a state in which the cores are made to float by air flow, and a kneader coater method of mixing the cores of the carrier and the solution for forming the covering layer in a kneader coater and then removing a solvent.

A mixing ratio (weight ratio) between the toner and the carrier in the two-component developer is preferably from toner:carrier=1:100 to 30:100, and more preferably from 3:100 to 20:100.

Image Forming Apparatus/Image Forming Method

Description will be given of an image forming apparatus and an image forming method according to the exemplary embodiment.

The image forming apparatus according to the exemplary embodiment includes an image holding member, a charging unit that charges a surface of the image holding member, an electrostatic charge image forming unit that forms an electrostatic charge image on the charged surface of the image holding member, a developing unit that accommodates an electrostatic charge image developer and develops the electrostatic charge image formed on the surface of the image holding member as a toner image by using the electrostatic charge image developer, a transfer unit that transfers the toner image formed on the surface of the image holding member to a surface of a recording medium, a cleaning unit that includes a cleaning blade for cleaning the surface of the image holding member; and a fixing unit that fixes the toner image transferred to the surface of the recording medium. The electrostatic charge image developer according to the exemplary embodiment is applied as the electrostatic charge image developer.

The image forming apparatus according to the exemplary embodiment performs the image forming method (the image forming method according to the exemplary embodiment) including a charging process of charging the surface of the image holding member, an electrostatic charge image formation process of forming the electrostatic charge image on the charged surface of the image holding member, a developing process of developing the electrostatic charge image formed on the surface of the image holding member as the toner image by using the electrostatic charge image developer according to the exemplary embodiment, a transfer process of transferring the toner image formed on the surface of the image holding member to the surface of the recording medium, a cleaning process of cleaning the surface of the image holding member by using the cleaning blade, and a fixing process of fixing the toner image transferred to the surface of the recording medium.

As the image forming apparatus according to the exemplary embodiment, a known image forming apparatus such as: a direct transfer-type apparatus that directly transfers the toner image formed on the surface of the image holding member to the recording medium; an intermediate transfer-type apparatus that primarily transfers the toner image formed on the surface of the image holding member to a surface of an intermediate transfer member and secondarily transfers the toner image transferred to the surface of the intermediate transfer member to the surface of the recording image; an apparatus provided with a cleaning unit that cleans the surface of the image holding member before the charging and after the transferring of the toner image; or an apparatus provided with an erasing unit that erases the charge by irradiating the surface of the image holding member with erasing light before the charging and after the transferring of the toner image is applied.

In a case of the intermediate transfer-type apparatus, a structure including an intermediate transfer member with a surface to which the toner image is transferred, a primary transfer unit that primarily transfers the toner image formed on the surface of the image holding member to the surface of the intermediate transfer member, and a secondary transfer unit that secondarily transfers the toner image transferred to the surface of the intermediate transfer member to the surface of the recording medium, for example, is applied to the transfer unit.

In the image forming apparatus according to the exemplary embodiment, a portion including the developing unit, for example, may have a cartridge structure (process cartridge) that is detachable from the image forming apparatus. As the process cartridge, a process cartridge that accommodates the electrostatic charge image developer according to the exemplary embodiment and is provided with the developing unit is preferably used.

Hereinafter, an example of the image forming apparatus according to the exemplary embodiment will be shown. However, the image forming apparatus is not limited thereto. In addition, main components illustrated in the drawings will be described, and descriptions of the other components will be omitted.

FIG. 1 is a configuration diagram schematically illustrating the image forming apparatus according to the exemplary embodiment.

The image forming apparatus illustrated in FIG. 1 includes first to fourth image forming units 10Y, 10M, 10C, and 10K (image forming units) based on an electrophotography scheme, which output images of the respective colors, namely yellow (Y), magenta (M), cyan (C), and black (K) based on image data of separated colors. These image forming units (hereinafter, also simply referred to as "units") 10Y, 10M, 10C, and 10K are aligned at a predetermined interval in the horizontal direction. These units 10Y, 10M, 10C, and 10K may be a process cartridge that is detachable from the image forming apparatus.

On the upper side in the drawing of the respective units 10Y, 10M, 10C, and 10K, an intermediate transfer belt 20 as an intermediate transfer member extends through the respective units. The intermediate transfer belt 20 is provided so as to be wound around a drive roller 22 and a support roller 24 in contact with inner surfaces of the intermediate transfer belt 20, which are arranged so as to separate from each other in the direction from the left side to the right side in the drawing, and the intermediate transfer belt 20 travels in the direction from the first unit 10Y toward the fourth unit 10K. Force in a direction away from the drive roller 22 is applied to the support roller 24 by a spring or the like, which is not illustrated in the drawing, and tension force is applied to the intermediate transfer belt 20 wound around both the support roller 24 and the drive roller 22. An intermediate transfer member cleaning device 30 is provided on a surface of the intermediate transfer belt 20 on the side of the image holding member so as to face the drive roller 22.

Toner including four-color toner of yellow, magenta, cyan, and black accommodated in toner cartridges 8Y, 8M, 8C, and 8K is supplied to the respective developing devices (developing units) 4Y, 4M, 4C, and 4K of the respective units 10Y, 10M, 10C, and 10K.

Since the first to fourth units 10Y, 10M, 10C, and 10K have the same configuration, the first unit 10Y that is disposed on the upstream side in the intermediate transfer belt traveling direction will be described as a representative. Descriptions of the second to fourth units 10M, 10C, and 10K will be omitted by applying reference numerals indicating magenta (M), cyan (C), and black (K) instead of yellow (Y) at the same portions in the description of the first unit 10Y.

The first unit 10Y includes a photoreceptor 1Y that acts as an image holding member. In the periphery of the photoreceptor 1Y, a charging roller (an example of the charging unit) 2Y that charges the surface of the photoreceptor 1Y to have a predetermined potential, an exposure device (an example of the electrostatic charge image forming unit) 3 that exposes the charged surface with a laser beam 3Y based on an image signal of a separated color and forms an electrostatic charge image, a developing device (an example of the developing unit) 4Y chat supplies charged toner to the electrostatic charge image and develops the electrostatic charge image, a primary transfer roller 5Y (an example of the primary transfer unit) that transfers the developed toner image to the intermediate transfer belt 20, and a cleaning device (an example of the cleaning unit) 6Y that includes a cleaning blade 6Y-1 for removing the toner remaining on the surface of the photoreceptor 1Y after the primary transfer are arranged in order.

The primary transfer roller 5Y is arranged inside the intermediate transfer belt 20 and is provided at such a position that the primary transfer roller 5Y faces the photoreceptor 1Y. Furthermore, bias power sources (not shown) for applying primary transfer biases are connected to the respective primary transfer rollers 5Y, 5M, 5C, and 5K, respectively. The respective bias power sources vary the transfer biases to be applied to the respective primary transfer rollers in response to control by a control unit, which is not shown in the drawing.

Hereinafter, description will be given of operations of forming a yellow image by the first unit 10Y.

First, the charging roller 2Y charges the surface of the photoreceptor 1Y to have a potential from −600 V to −800 V prior to the operations.

The photoreceptor 1Y is formed by laminating a photosensitive layer on a conductive (volume resistivity at 20° C.: equal to or less than $1\times10^{-6}$ Ωcm, for example) base material. Although the photosensitive layer typically has high resistance (resistance of typical resin), the photosensitive layer has a characteristic that specific resistance at a portion irradiated with a laser beam changes in a case of being irradiated with the laser beam 3Y. Thus, the laser beam 3Y is output to the charged surface of the photoreceptor 1Y via the exposure device 3 in accordance with yellow image data sent from the control unit, which is not illustrated in the drawing. The photosensitive layer on the surface of the photoreceptor 1Y is irradiated with the laser beam 3Y, and an electrostatic charge image of a yellow image pattern is thus formed on the surface of the photoreceptor 1Y.

The electrostatic charge image is an image formed on the surface of the photoreceptor 1Y by the charging, and is a so-called negative latent image that is formed by lowering the specific resistance at the irradiated portion of the photosensitive layer with the laser beam 3Y and causing electric charge on the charged surface of the photoreceptor 1Y to flow while causing the electric charge at a portion that is not irradiated with the laser beam 3Y to remain.

The electrostatic charge image formed on the photoreceptor 1Y is rotated at a predetermined development position in response to traveling of the photoreceptor 1Y. Then, the electrostatic charge image on the photoreceptor 1Y is visualized (developed) as a toner image by the developing device 4Y.

The developing device 4Y accommodates an electrostatic charge image developer that contains at least a yellow toner and a carrier, for example. The yellow toner is fractionally charged by being stirred in the developing device 4Y and is held on the developer roller (an example of the developer holding member) with electric charge with the same polarity (negative polarity) as that of the electric charge on the charged photoreceptor 1Y. Then, the yellow toner electrostatically adheres to a latent image portion, from which the charge is erased, on the surface of the photoreceptor 1Y by the surface of the photoreceptor 1Y passing through the developing device 4Y, and the latent image is developed by the yellow toner. The photoreceptor 1Y with the yellow toner image formed thereon is made to continuously travel at a predetermined speed, and the toner image developed on the photoreceptor 1Y is transported to a predetermined primary transfer position.

If the yellow toner image on the photoreceptor 1Y is transferred to the primary transfer, then the primary transfer bias is applied to the primary transfer roller 5Y, electrostatic force directed from the photoreceptor 1Y to the primary transfer roller 5Y acts on the toner image, and the toner image on the photoreceptor 1Y is transferred to the intermediate transfer belt 20. The transfer bias applied at this time has (+) polarity that is opposite to the polarity (−) of the toner, and the transfer bias in the first unit 10Y is controlled to +10 μA by the control unit (not shown), for example.

In contrast, the toner remaining on the photoreceptor 1Y is removed ad collected by the photoreceptor cleaning device 6Y.

The primary transfer biases to be applied to the primary transfer rollers 5M, 5C, and 5K of the second unit 10M and the following units are also controlled in the same manner as the first unit.

As described above, the intermediate transfer belt 20 to which the yellow toner image is transferred by the first unit 10Y is sequentially transported through the second to fourth units 10M, 10C, and 10K, toner images of the respective colors are transferred in an overlapped manner.

The intermediate transfer belt 20, to which the toner images of the four colors have been transferred in the overlapped manner through the first to fourth units, reaches a secondary transfer unit that includes the intermediate transfer belt 20, the support roller 24 in contact with the inner surface of the intermediate transfer belt, and a secondary transfer roller (an example of the secondary transfer unit) 26 arranged on the side of the image holding surface of the intermediate transfer belt 20. In contrast, a recording sheet (an example of the recording medium) P is supplied to a contact clearance between the secondary transfer roller 26 and the intermediate transfer belt 20 via a supply mechanism at predetermined timing, and a secondary transfer bias is applied to the support roller 24. The transfer bias applied at this time has (−) polarity that is the same as the polarity (−) of the toner, electrostatic force directed from the intermediate transfer belt 20 to the recording sheet P acts on the toner image, and the toner image on the intermediate transfer belt 20 is transferred to the recording sheet P. The secondary transfer bias applied at this time is determined in accordance with resistance detected by a resistance detecting unit (not shown) for detecting the resistance of the secondary transfer unit, and voltage controlled is performed thereon.

Thereafter, the recording sheet P is sent to a nip portion of a pair of fixing rollers in a fixing device (an example of the fixing unit) 28, the toner image is fixed on the recording sheet P, and a fixed image is formed.

Examples of the recording sheet P to which the transfer image is transferred include a plain paper used in a copying machine based on the electrophotography scheme, a printer, or the like. Examples of the recording medium other than the recording sheet P also include an OHP sheet.

In order to further enhancing smoothness of the surface of the image after the fixation, the recording sheet P also has a smooth surface, and for example, a coated paper obtained by coating a surface of a plain paper with resin or the like or an art paper for printing is preferably used.

The recording sheet P, on which the fixation of the color image is completed, is transported to a discharge unit, and the series of color image forming operations are completed.

Process Cartridge/Toner Cartridge

Description will be given of a process cartridge according to the exemplary embodiment.

The process cartridge according to the exemplary embodiment includes a developing unit that accommodates the electrostatic charge image developer according to the exemplary embodiment and develops, as a toner image, the electrostatic charge image formed on the surface of the image holding member by using the electrostatic charge image developer, and the process cartridge is detachable from the image forming apparatus.

The process cartridge according to the exemplary embodiment is not limited to the above configuration, and may be configured to include the developing device, and if necessary, at least one selected from other units such as the image holding member, the charging unit, the electrostatic charge image forming unit, and the transfer unit.

Hereinafter, an example of the process cartridge according to the exemplary embodiment will be shown. However, the process cartridge is not limited thereto. In addition, main components illustrated in the drawing will be described, and description of the other components will be omitted.

Figure 2:
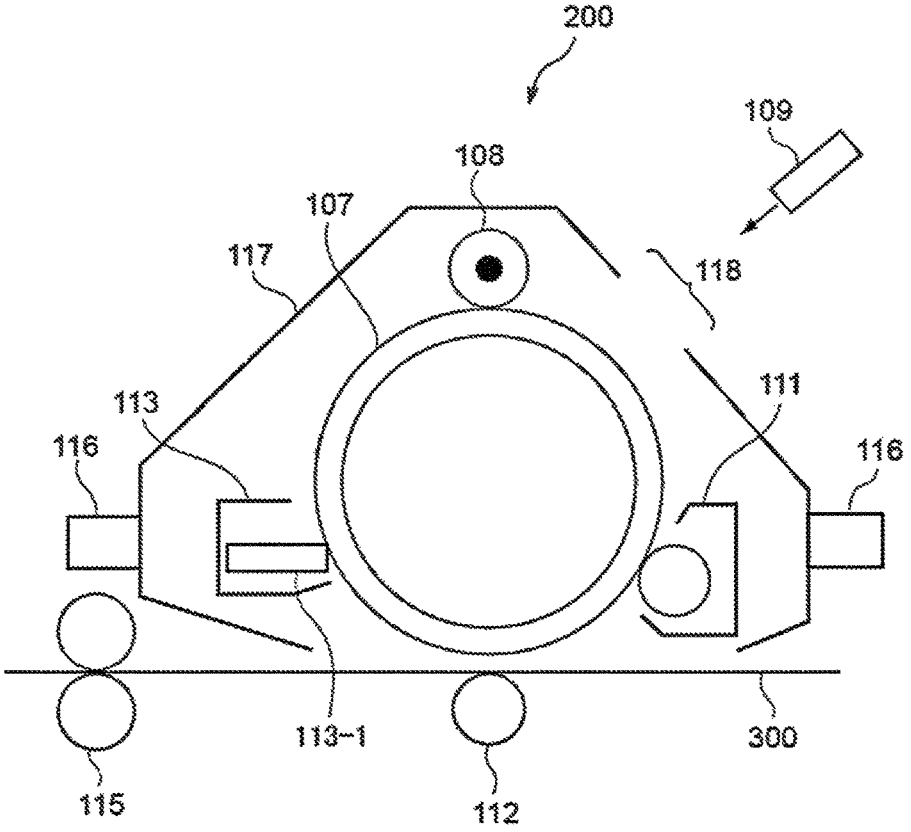
FIG. 2 is a configuration diagram schematically illustrating an example of a process cartridge according to the exemplary embodiment.

FIG. 2 is a configuration diagram schematically illustrating the process cartridge according to the exemplary embodiment.

In process cartridge 200 illustrated in FIG. 2 is configured such that a photoreceptor 107 (an example of the image holding member), a charging roller 108 (an example of the charging unit) provided in the periphery of the photoreceptor 107, a developing device 111 (an example of the developing unit), and a photoreceptor cleaning device 113 (an example of the cleaning unit) including a cleaning blade 113-1 are integrally combined and held in a housing 117 provided with an attachment rail 116 and an opening 118 for exposure, for example, and is formed as a cartridge.

In FIG. 2, 109 represents an exposure device (an example of the electrostatic charge image forming unit), 112 represents a transfer device (an example of the transfer unit), 115 represents a fixing device (an example of the fixing unit), and 300 represents a recording sheet (an example of the recording medium).

Next, description will be given of a toner cartridge according to the exemplary embodiment.

The toner cartridge according to the exemplary embodiment is a toner cartridge that accommodates the toner according to the exemplary embodiment and is detachable from the image forming apparatus. The toner cartridge is for accommodating the toner for replenishment to be supplied to the developing unit provided in the image forming apparatus. The toner cartridge according to the exemplary embodiment may have a container which contains the toner according to the exemplary embodiment.

The image forming apparatus illustrated in FIG. 1 is an image forming apparatus with a configuration to and from which the toner cartridges 8Y, 8M, 8C, and 8K are attached and detached, and the developing devices 4Y, AM, 4C, and 4K are connected to the toner cartridges corresponding to the respective developing devices (colors) with toner supply tubes, which are not illustrated in the drawing. In a case in which the amount of the toner accommodated in a toner cartridge decreases, the toner cartridge is replaced.

EXAMPLES

Although more detailed description will be given below of the exemplary embodiment based on examples, the exemplary embodiment is not limited to these examples. In the following description, all the expressions "parts" and "%" represent "parts by weight" and "% by weight" unless otherwise particularly indicated.

Preparation of Toner Particles

Preparation of Toner Particles (1)

Styrene-butyl acrylate copolymer (copolymerization ratio (weight ratio)=80:20, weight average molecular weight Mw=130,000, glass transition temperature Tg=59° C.): 88 parts Cyan pigment (C.I. pigment blue 15:3): 6 parts Low-molecular-weight polypropylene (softening temperature: 148° C.): 6 parts The above materials are mixed by a HENSCHEL MIXER and are then hot-kneaded by an extruder. After cooling, the kneaded substance is coarsely/finely pulverized, the pulverized substances are further classified, and toner particles (1) with a volume average particle diameter of 6.5 μm are obtained. The exposure rate of the release agent (low-molecular-weight polypropylene) in the toner particles (1) is 25 atom %. The average circularity of the particles (1) is 0.92.

Preparation of Toner Particles (2)

Toner particles (2) with a volume average particle diameter of 6.6 μm, a release agent exposure amount of 36 atom %, and average circularity of 0.94 are prepared by changing pulverizing and classifying conditions from those for the toner particles (1) and further performing hot air processing.

Preparation of Toner Particles (3)

Toner particles (3) with a volume average particle diameter of 6.4 μm, a release agent exposure amount of 12 atom %, and average circularity of 0.91 are prepared in the same manner as the toner particles (2).

Preparation of Toner Particles (4)

Toner particles (4) with a volume average particle diameter of 6.5 μm, a release agent exposure amount of 7 atom %, and average circularity of 0.89 are prepared in the same manner as the toner particles (2).

Preparation of Toner Particles (5)

Toner particles (5) with a volume average particle diameter of 6.3 μm, a release agent exposure amount of 21 atom %, and average circularity of 0.93 are prepared In the same manner as the toner particles (2).

Preparation of Toner Particles (6)

Toner particles (6) with a volume average particle diameter of 6.4 μm, a release agent exposure amount of 21 atom %, and average circularity of 0.94 are prepared in the same manner as the toner particles (1) other than that low-molecular-weight polypropylene is changed from 6 parts to 10 parts in the toner particles (1).

Preparation of Toner Particles (7)

Preparation of Unmodified Polyester Resin

Bisphenol A-ethylene oxide adduct: 160 parts
Bisphenol A-propylene oxide adduct: 15 parts
Terephthalic acid: 220 parts The above monomers are put into a three-necked flask completely dried and substituted with $N_2$, the monomer is heated at 180° C. and is melted while $N_2$, is fed, and the monomer is then sufficiently mixed. After adding 0.1 parts of dibutyl tin oxide thereto, the temperature in the system is increased to 205° C., and the reaction is made to advance while the temperature is maintained. The progress of the reaction is controlled by adjusting the temperature and collecting humidity in a reduced-pressure atmosphere while measuring the molecular weight of a small amount of collected sample, and a desired condensate is thus obtained.

Preparation of Polyester Prepolymer

Bisphenol A-etylene oxide adduct: 182 parts
Bisphenol A-propylene oxide adduct: 21 parts
Terephthalic acid: 7 parts
Isophtnslic acid: 85 parts The above monomers are put into a three-necked flask completely dried and substituted with $N_2$, the monomer is heated at 180° C. and is melted while $N_2$ is fed, and the monomer is then sufficiently mixed. After adding 0.4 parts of dibutyl tin oxide thereto, the temperature in the system is increased to 205° C., and the reaction is made to advance while the temperature is maintained. The progress of the reaction is controlled by adjusting the temperature and collecting humidity in a reduced-pressure atmosphere while measuring the molecular weight of a small amount of collected sample, and a desired condensate is thus obtained. Next, the temperature is lowered to 175° C., 8 parts of phthalic anhydride is then added thereto, and the mixture is stirred for 3 hours in a reduced-pressure atmosphere to cause the reaction.

330 parts of the thus obtained condensate, 25 parts of isophorone diisocyanate, and 410 parts of ethyl acetate are put into another three-necked flask completely dried and substituted with $N_2$, the mixture is heated at 70° C. for 5 hours while $N_2$ is fed thereto, and polyester prepolymer having isocyanate groups (hereinafter, "isocyanate-modified polyester prepolymer") is obtained.

Preparation of Ketimine Compound

Methyl ethyl ketone: 20 parts
Isophorone diamine: 15 parts

The above materials are put into a container and are stirred while heated at 58° C., and a ketimine compound is thus obtained.

Preparation of Pigment Dispersion

Cyan pigment (Pigment Blue 15:3 manufactured by Dainichiseika Color & Chemicals Mfg. Co., Ltd.): 15 parts
Ethyl acetate: 65 parts
SOLSPERSE 5000 (manufactured by Zeneca Inc.): 1.2 parts The above components are mixed and dissolved/dispersed by using a sand mill, and a pigment dispersion is thus obtained.

Preparation of Release Agent Dispersion

Paraffin wax (melting temperature: 89° C.): 20 parts
Ethyl acetate: 220 parts

The above components are wet-pulverized by a micro bead-type disperser (DCP mil) in a state of being cooled at 18° C., and a release agent dispersion is thus obtained.

Preparation of Oil Phase Solution

Pigment dispersion: 32 parts
Bentonite (manufactured by Wako Pure Chemical Industries, Ltd.): 8 parts
Ethyl acetate: 58 parts The above components are put and sufficiently stirred and mixed. 140 parts of unmodified polyester resin and 75 parts of release agent dispersion are added to the obtained mixture solution, the mixture is sufficiently stirred, and an oil phase solution is prepared.

Preparation of Styrene Acrylic Resin Particle Dispersion (2)

Styrene: 75 parts
n-Butyl acrylate: 115 parts
Methacrylic acid: 75 parts
Polyoxyalkylene methacrylate sulfate ester Na (ELEMINOL RS-30 manufactured by Sanyo Chemical Industries Co., Ltd.): 8 parts
Dodocanothiol: 4 parts The above components are put into a reactor capable of refluxing and are sufficiently stirred and mixed. 800 parts of ion-exchanged water and 1.2 parts of ammonium persulfate are quickly put into the mixture and are dispersed and emulsified by a homogenizer (ULTRATURRAX T50 manufactured by IKA) while the temperature is maintained to be equal to or less than the room temperature, and a white emulsified solution is thus obtained. The temperature in the system is increased to 70° C. while $N_2$ is fed and the mixture is stirred, and emulsification polymerization is continued as it is for 5 hours. Furthermore, 18 parts of 1% aqueous solution of ammonium persulfate is slowly dropped thereto, the temperature is then maintained at 70° C. for 2 hours, and the polymerization is completed.

Preparation of Water Phase Solution

Styrene acrylic resin particle dispersion (2): 50 parts
2% aqueous solution of CELOGEN BS-H (CMC, DKS Co., Ltd.): 170 parts
Anionic surfactant (DOWFAX 2A1 manufactured by Dow Chemical Company): 3 parts
Ion-exchanged water: 230 parts The above components are sufficiently stirred and mixed, and a water phase solution is thus prepared.

Preparation of Toner Particles (7)

Oil phase solution: 370 parts
Isocyanate-modified polyester prepolymer: 25 parts
Ketimine compound: 1.5 parts The above components are put into a round-bottom flask made of stainless steel and are stirred by a homogenizer (ULTRATURRAX manufactured by IKA) for 2 minutes, a mixed oil phase solution is thus prepared, 900 parts of water phase solution is then added to the flask, and the mixture is quickly and forcibly emulsified by a homogenizer (8000 rpm) for about 1 minute. Then, the emulsion is stirred at a temperature of equal to or less than the ordinary temperature under an ordinary pressure (1 atm) for about 15 minutes by using a paddle-type stirrer, and formation of particles and a urea modification reaction of polyester resin are made to advance. Thereafter, the mixture is stirred at 75° C. for 8 hours while the solvent is evaporated at a reduced pressure or is removed at the ordinary pressure, and the urea modification reaction is completed.

After cooling the resultant to the ordinary temperature, the suspension of the formed particles is extracted, sufficiently washed with ion-exchanged water, and is subjected to solid liquid separation by Nutsche suction filtration. Next, the suspension is dispersed again in ion-exchanged water at 35° C. and is washed for 15 minutes while stirred. The washing operation is repeated several times, the solid liquid separation by the Nutsche suction filtration is performed, the suspension is freeze-dried in vacuum, and toner particles (7) are thus obtained.

At this time, the volume average particle diameter is 6.4 μm, the release agent exposure amount is 0.1 atom %, and the average circularity is 0.97.

Preparation of Toner Particles (8)

Toner particles (8) with a volume average particle diameter of 6.3 μm, a release agent exposure amount of 23 atom %, and average circularity of 0.97 are prepared in the same manner as the toner particles (7) other than that the amount of the release agent dispersion is changed from 75 parts to 100 parts and the urea modification reaction conditions are changed from 75° C. for 8 hours to 85° C. for 12 hours in the toner particles (7).

Preparation of External Additive

Preparation of Silica Particle Dispersion (1)

300 parts of methanol and 70 parts of 10% ammonia aqueous solution are added to and mixed in a 1.5 L reactor made of glass and provided with a stirrer, a dropping nozzle, and a thermometer, and an alkali catalytic solution is thus obtained.

After the temperature of the alkali catalytic solution is adjusted to 30° C., 185 parts of tetramethoxysilane and 50 parts of 8.0% ammonia aqueous solution are dropped at the same time while stirring is performed, and a hydrophilic silica particle dispersion (solid content concentration: 12.0% by weight) is thus obtained. Here, the dropping time is set to 30 minutes.

Thereafter, the obtained silica particle dispersion is concentrated to solid content concentration of 40% by weight by a rotary filter R-FINE (manufactured by Kotobuki Industries Co., Ltd.). The concentrated substance is obtained as a silica particle dispersion (1).

Preparation of Silica Particle Dispersions (2) to (8)

Silica particle dispersions (2) to (8) are prepared in the same manner as the silica particle dispersion (1) other than that the alkali catalytic solution (the amount of methanol and the amount of 10% ammonia aqueous solution) and the silica particle formation conditions (the total amount of tetramethoxysilane (described as TMOS) and 8% ammonia aqueous solution dropped to the alkali catalytic solution and dropping time thereof) are changed in accordance with Table 1 in the preparation of the silica particle dispersion (1).

Details of the silica particle dispersions (1) to (8) will be shown below in Table 1.

an autoclave provided with a stirrer (content of 500 ml), and a pressure valve is used.

First, 250 parts of the silica particle dispersion (1) is put into the autoclave with a stirrer (content of 500 ml), and the stirrer is rotated at 100 rpm. Thereafter, liquefied carbon dioxide is poured into the autoclave, the pressure is boosted by the carbon dioxide pump while the temperature is raised by a heater, and a supercritical state at 150° C. and 15 MPa is obtained in the autoclave. Supercritical carbon dioxide is distributed by the carbon dioxide pump while the pressure in the autoclave is maintained at 15 MPa by the pressure valve, methanol and water are removed from the silica particle dispersion (1) (solvent removing process), and silica particles (untreated silica particles) are thus obtained.

Next, the distribution of supercritical carbon dioxide is stopped at the timing when the amount of supercritical carbon dioxide distributed (the cumulative amount: measured as the amount of carbon dioxide distributed in a standard state) reaches 900 parts.

Thereafter, a processing agent solution, which is obtained by dissolving 0.3 carts of dimethyl silicons oil (DSO: product name "KF-96 (manufactured by Shin-Etsu Chemical Co., Ltd.)") having a viscosity of 10,000 cSt as a siloxane compound in 20 parts of hexamethyldisilane (HMDS: manufactured by Yuki Gosei Kogyo Co., Ltd.) in advance as a hydrophobizing agent with respect to 100 parts of the above silica particles (untreated silica particles), is poured into the autoclave by the entrainer pump in a state where the supercritical state of carbon dioxide is maintained in the autoclave by maintaining the temperature at 150° C. by the heater and maintaining the pressure at 15 MPa by the carbon dioxide pump, and a reaction is then caused at 180° C. for 20 minutes while the processing agent solution is stirred. Thereafter, supercritical carbon dioxide is distributed again, and excessive processing agent solution is removed. Thereafter, the stirring is stopped, the pressure in the autoclave is opened to the atmospheric pressure by opening the pressure valve, and the temperature is lowered to the room temperature (25° C.).

The solvent removing process and the surface treatment with the siloxane compound are performed in order as described above, and surface treated silica particles (S1) are thus obtained.

Preparation of Surface Treated Silica Particles (S2) to (S5), (S1) to (S9), and (S12) to (S17)

TABLE 1

| | Alkali catalytic solution | | Silica particle formation conditions | | |
|---|---|---|---|---|---|
| Silica particle dispersion | Methanol (part) | 10% ammonium water (part) | Total dropping amount of TMOS (part) | Total dropping amount of 8% ammonium water (part) | Dropping time |
| (1) | 300 | 70 | 185 | 50 | 30 minutes |
| (2) | 300 | 70 | 340 | 92 | 55 minutes |
| (3) | 300 | 46 | 40 | 25 | 30 minutes |
| (4) | 300 | 70 | 62 | 17 | 10 minutes |
| (5) | 300 | 70 | 700 | 200 | 120 minutes |
| (6) | 300 | 70 | 500 | 140 | 85 minutes |
| (7) | 300 | 70 | 1000 | 280 | 170 minutes |
| (8) | 300 | 70 | 3000 | 800 | 520 minutes |

Preparation of Surface Treated Silica Particles (S1)

The silica particle dispersion (1) is used, to treat the surfaces of the silica particles with the siloxane compound in an atmosphere of supercritical carbon dioxide as follows. In the surface treatment, an apparatus that includes a carbon dioxide cylinder, a carbon dioxide pump, an entrainer pump, The surface treated silica particles (S2) to (S5), (S7) to (S9), and (S12) to (S17) are prepared in the same manner as the surface treated silica particles (S1) other than that the silica particle dispersion, the surface treatment conditions (the treatment atmosphere, the siloxane compound (type, viscosity, and other additives), the hydrophobizing agent, and the additive amount thereof) are changed in accordance with Table 2 in the preparation of the surface treated silica particles (S1).

Preparation of Surface Treated Silica Particles (S6)

The same dispersion as the silica particle dispersion (1) used in the preparation of the surface treated silica particles (S1) is used to treat the surfaces of the silica particles with the siloxane compound in the atmospheric air atmosphere as follows.

An ester adaptor and a cooling tube are attached to the reactor used in the preparation of the silica particle dispersion (1), the silica particle dispersion (1) is heated at 60° C. to 70° C., methanol is evaporated, water is then added, the silica particle dispersion (1) is further heated at 70° C. to 90° C. to evaporate methanol, and water dispersion of the silica particles is thus obtained. 3 parts of methyltrimethoxysilane (MTMS: manufactured by Shin-Etsu Chemical Co., Ltd.) is added to 100 parts of the silica particles in the water dispersion at the room temperature, a reaction is caused for 2 hours, and the surfaces of the silica particles are treated. After adding methyl isobutyl ketone to the surface treated dispersion, the mixture is heated at 80° C. to 110° C. to evaporate methanol solution, 80 parts of hexamethyldisilazane (HMDS: manufactured by Yuki Gosei Kogyo Co., Ltd.) and 1.0 parts of dimethyl silicon oil (DSO: product name "KF-96 (manufactured by Shin-Etsu Chemical Co., Ltd.)") having a viscosity of 10,000 cSt as a siloxane compound are added to 100 parts of silica solid content in the obtained dispersion, a reaction is caused at 120° C. for 3 hours, the mixture is cooled and then dried by spray drying, and surface treated silica particles (S6) are thus obtained.

Preparation of Surface Treated Silica Particles (S10)

Surface treated silica particles (S10) are prepared in the same manner as the surface treated silica particles (S1) other than that FUMED SILICA OX50 (AEROSIL OX50 manufactured by Nippon Aerosil Co., Ltd.) is used instead of the silica particle dispersion (1). That is, 100 parts of OX50 is put into the same autoclave provided with the stirrer as that used in the preparation of the surface treated silica particles (S1), and the stirrer is rotated at 100 rpm. Thereafter, liquefied carbon dioxide is poured into the autoclave, the pressure is boosted by the carbon dioxide pump while the temperature is raised by the heater, and the supercritical state at 180° C. at 15 MPa is obtained in the autoclave. A processing agent solution, which is obtained by dissolving 0.3 parts of dimethyl silicone oil (DSO: product name "KF-96 (manufactured by Shin-Etsu Chemical Co., Ltd.)") having a viscosity of 10,000 cSt as a siloxane compound in 20 parts of hexamethyldisilazane (HMDS: manufactured by Yuki Goaei Kogyo Co., Ltd.) in advance as a hydrophobizing agent, is poured into the autoclave by the entrainer pump while the pressure in the autoclave is maintained at 15 MPa by the pressure pump, a reaction is then caused at 180° C. for 20 minutes while the processing agent solution is stirred, supercritical carbon dioxide is then distributed, the excessive processing agent solution is removed, and surface treated silica particles (S10) are thus obtained.

Preparation of Surface Treated Silica Particles (S11)

Surface treated silica particles (S11) are prepared in the same manner as the surface treated silica particles (S1) other than that FUMED SILICA A50 (AEROSIL A50 manufactured by Nippon Aerosil Co., Ltd.) is used instead of the silica particle dispersion (1). That is, 100 parts of A50 is put into the same autoclave provided with the stirrer as that used in the preparation of the surface treated silica particles (S1), and the stirrer is rotated at 100 rpm. Thereafter, liquefied carbon dioxide is poured into the autoclave, the pressure is boosted by the carbon dioxide pump while the temperature is raised by the heater, and the supercritical state at 180° C. at 15 MPa is obtained in the autoclave. A processing agent solution, which is obtained by dissolving 1.0 parts of dimethyl silicone oil (DSC: product name "KF-96 (manufactured by Shin-Etsu Chemical Co., Ltd.)") having a viscosity of 10,000 cSt as a siloxane compound in 40 parts of hexamethyldisilane (HMDS: manufactured by Yuki Gosei Kogyo Co., Ltd.) in advance as a hydrophobizing agent, is poured into the autoclave by the entrainer pump while the pressure in the autoclave is maintained at 15 MPa by the pressure pump, a reaction is then caused at 180° C. for 20 minutes while the processing agent solution is stirred, super critical carbon dioxide is then distributed, the excessive processing agent solution is removed, and surface treated silica particles (S11) are thus obtained.

Preparation of Surface Treated Silica Particles (SC1)

Surface treated silica particles (SC1) are prepared in the same manner as the surface treated silica particles (S1) other than that the siloxane compound is not added in the preparation of the surface treated silica particles (S1).

Preparation of Surface Treated Silica Particles (SC2) to (SC4)

Surface treated silica particles (SC2) to (SC4) are produced in the same manner as the surface treated silica particles (S1) other than that the silica particle dispersion, the surface treatment conditions (the treatment atmosphere, the siloxane compound (type, viscosity, and additive amount thereof), the hydrophobizing agent, and the additive amount thereof) are changed in accordance with Table 3 in the preparation of the surface treated silica particles (S1).

Preparation of Surface Treated Silica Particles (SC5)

Surface treated silica particles (SC5) are prepared in the same manner as the surface treated silica particles (S6) other than that the siloxane compound is not added in the preparation of the surface treated silica particles (S6).

Preparation of Surface Treated Silica Particles (SC6)

Surface treated silica particles (SC6) are prepared by filtering the silica particle dispersion (9), drying the resulting substance at 120° C., putting the resulting substance into an electric furnace, burning the resulting substance at 400° C. for 6 hours, then spraying 10 parts of HMDS with respect to 100 parts of silica particles and drying the resulting substance in the form of spray dry.

Physical Properties of Surface Treated Silica Particles

Average equivalent circle diameters, average circularity, attachment amounts of the siloxane compounds to the untreated silica particles (described as "surface attachment amount" in the table), compression aggregation degrees, particle compression ratios, and particle dispersion degree of the obtained surface treated silica particles are measured by the above methods.

Details of the surface treated silica particles will be listed in Tables 2 and 3 shown below. The abbreviations in Tables 2 and 3 are as follows.

DSO: dimethyl silicone oil

HMDS: hexamethyldisilazane

TABLE 2

| Surface treated silica particles | Silica particles dispersion | Surface treatment conditions: Siloxane compound: Type | Viscosity (cSt) | Additive amount (part) | Treatment atmosphere | Hydrophobizing agent/part |
|---|---|---|---|---|---|---|
| (S1) | (1) | DSO | 10000 | 0.3 parts | Supercritical $CO_2$ | HMDS/20 parts |
| (S2) | (1) | DSO | 10000 | 1.0 parts | Supercritical $CO_2$ | HMDS/20 parts |
| (S3) | (1) | DSO | 5000 | 0.15 parts | Supercritical $CO_2$ | HMDS/20 parts |
| (S4) | (1) | DSO | 5000 | 0.5 parts | Supercritical $CO_2$ | HMDS/20 parts |
| (S5) | (2) | DSO | 10000 | 0.2 parts | Supercritical $CO_2$ | HMDS/20 parts |
| (S6) | (1) | DSO | 10000 | 1.0 parts | Atmospheric air | HMDS/80 parts |
| (S7) | (3) | DSO | 10000 | 0.3 parts | Supercritical $CO_2$ | HMDS/20 parts |
| (S8) | (4) | DSO | 10000 | 0.3 parts | Supercritical $CO_2$ | HMDS/20 parts |
| (S9) | (1) | DSO | 50000 | 1.5 parts | Supercritical $CO_2$ | HMDS/20 parts |
| (S10) | FUMED SILICA OX50 | DSO | 10000 | 0.3 parts | Supercritical $CO_2$ | HMDS/20 parts |
| (S11) | FUMED SILICA A50 | DSO | 10000 | 1.0 parts | Supercritical $CO_2$ | HMDS/40 parts |
| (S12) | (3) | DSO | 5000 | 0.04 parts | Supercritical $CO_2$ | HMDS/20 parts |
| (S13) | (3) | DSO | 1000 | 0.5 parts | Supercritical $CO_2$ | HMDS/20 parts |
| (S14) | (3) | DSO | 10000 | 5.0 parts | Supercritical $CO_2$ | HMDS/20 parts |
| (S15) | (5) | DSO | 10000 | 0.5 parts | Supercritical $CO_2$ | HMDS/20 parts |
| (S16) | (6) | DSO | 10000 | 0.5 parts | Supercritical $CO_2$ | HMDS/20 parts |
| (S17) | (7) | DSO | 10000 | 0.5 parts | Supercritical $CO_2$ | HMDS/20 parts |

| Surface treated silica particles | Properties of surface treated silica particles: Average equivalent circle diameter (nm) | Average circularity | Surface attachment amount (% by weight) | Compression aggregation degree (%) | Particle compression ratio | Particle dispersion degree (%) |
|---|---|---|---|---|---|---|
| (S1) | 120 | 0.958 | 0.28 | 85 | 0.310 | 98 |
| (S2) | 120 | 0.958 | 0.98 | 92 | 0.280 | 97 |
| (S3) | 120 | 0.958 | 0.12 | 80 | 0.320 | 99 |
| (S4) | 120 | 0.958 | 0.47 | 88 | 0.295 | 98 |
| (S5) | 140 | 0.962 | 0.19 | 81 | 0.350 | 99 |
| (S6) | 120 | 0.958 | 0.50 | 83 | 0.380 | 93 |
| (S7) | 130 | 0.850 | 0.29 | 68 | 0.350 | 92 |
| (S8) | 90 | 0.935 | 0.29 | 94 | 0.390 | 95 |
| (S9) | 120 | 0.958 | 1.25 | 95 | 0.240 | 91 |
| (S10) | 80 | 0.880 | 0.26 | 84 | 0.395 | 92 |
| (S11) | 45 | 0.880 | 0.91 | 88 | 0.276 | 91 |
| (S12) | 130 | 0.850 | 0.02 | 62 | 0.360 | 96 |
| (S13) | 130 | 0.850 | 0.46 | 90 | 0.380 | 92 |
| (S14) | 130 | 0.850 | 4.70 | 95 | 0.360 | 91 |
| (S15) | 185 | 0.971 | 0.43 | 61 | 0.209 | 96 |
| (S16) | 164 | 0.97 | 0.41 | 64 | 0.224 | 97 |
| (S17) | 210 | 0.978 | 0.44 | 60 | 0.205 | 98 |

TABLE 3

| Surface treated silica particles | Silica particle dispersion | Surface treatment conditions: Siloxane compound: Type | Viscosity (cSt) | Additive amount (part) | Treatment atmosphere | Hydrophobizing agent/part |
|---|---|---|---|---|---|---|
| (SC1) | (1) | — | — | — | Supercritical $CO_2$ | HMDS/20 parts |
| (SC2) | (1) | DSO | 100 | 3.0 parts | Supercritical $CO_2$ | HMDS/20 parts |
| (SC3) | (1) | DSO | 1000 | 8.0 parts | Supercritical $CO_2$ | HMDS/20 parts |
| (SC4) | (3) | DSO | 3000 | 10.0 parts | Supercritical $CO_2$ | HMDS/20 parts |
| (SC5) | (1) | — | — | — | Atmospheric air | HMDS/80 parts |
| (SC6) | (8) | — | — | — | Atmospheric air | HMDS/10 parts |

| Surface treated silica particles | Properties of surface treated silica particles: Average equivalent circle diameter (nm) | Average circularity | Surface Attachment amount (% by weight) | Compression aggregation degree (%) | Particle compression ratio | Particle dispersion degree (%) |
|---|---|---|---|---|---|---|
| (SC1) | 120 | 0.958 | — | 55 | 0.415 | 99 |
| (SC2) | 120 | 0.958 | 2.5 | 98 | 0.450 | 75 |

TABLE 3-continued

| | | | | | | |
|---|---|---|---|---|---|---|
| (SC3) | 120 | 0.958 | 7.0 | 99 | 0.360 | 83 |
| (SC4) | 130 | 0.850 | 8.5 | 99 | 0.380 | 85 |
| (SC5) | 120 | 0.958 | — | 82 | 0.425 | 98 |
| (SC6) | 300 | 0.980 | — | 60 | 0.197 | 93 |

Examples 1 to 22 and Comparative Examples 1 to 7

The silica particles shown in Tables 4 and 5 are added to 100 parts of the toner particles shown in Tables 4 and 5 at amounts shown in Tables 4 and 5, the particles are mixed at 2000 rpm for 3 minutes by a KENSCHEL MIXER, and toners in the respective examples are obtained.

Then, each obtained toner and a carrier are put into a V BLENDER at a rate of toner:carrier=5:95 (weight ratio), the toner and the carrier are stirred for 20 minutes, and each developer is thus obtained.

The carrier prepared as follows is used.

Ferrite particles (volume average particle diameter: 50 μm): 100 parts

Toluene: 14 parts

Styrene-methyl methacrylate copolymer: 2 parts (component ratio: 90/10, Mw=80000)

Carbon black (R330: manufactured by Cabot Corporation): 0.2 parts

First, the above components except for the ferrite particles are stirred by a stirrer for 10 minutes, a dispersed coating solution is prepared, the coating solution and the ferrite particles are then put into a vacuum deaeration-type kneader and are stirred at 60° C. for 30 minutes. Then, a carrier is thus obtained by performing depressurization, deaeration, and drying while further warming the covering solution and the ferrite particles.

Evaluation

For the developers obtained in the respective examples, charge holding properties of the toner and crack on the photoreceptor are evaluated. The results will be shown in Table 4.

Charge Holding Property of Toner

In the evaluation of crack on the photoreceptor described below, the initial charge amount of the toner before image formation, the charge amounts of the toner after elapse of time after the printing (the charge amounts after printing 5 thousand images, after printing 15 thousand images, and after printing 30 thousand images) by a blow-off charge amount measurement apparatus (TB-200 manufactured by Toshiba Chemical Corporation).

The charge holding properties are evaluated by evaluation criteria based on the following equation.

charge holding property (%)=(1−(charge amount of toner after elapse of time/initial charge amount of toner)×100 Equation The evaluation criteria are as follows.

A: equal to or less than 5%

B: greater than 5% and equal to or less than 10%

C: greater than 10% and equal to or less than 15%

D: greater than 15%

Crack on Photoreceptor

A developing device in an image forming apparatus (DocuCentre-III C7600 manufactured by Fuji Xerox Co., Ltd.) is filled with the developer obtained in each example. 30,000 images having an image density of 1.5 and an image area of 10% are printed on A4 sheets by the image forming apparatus in an environment at a temperature of 20° C. and a humidity of 20% RH. In this process, the surface of the photoreceptor is observed after printing 5 thousand images, 15 thousand images, and 30 thousand images, and crack on the surface of the photoreceptor is evaluated by the following evaluation criteria.

A: No crack is observed.

B: Slight crack is observed, and no defect is observed in image qualify.

C: Crack is observed, and slight defect is observed in image quality.

D: Crack is observed, and defect such as streak is observed in image quality.

TABLE 4

| | Developer | | | Charge holding property of toner | | |
|---|---|---|---|---|---|---|
| | Toner | Surface treated silica particles | | Initial stage | After printing 5 | After printing 15 |
| | particles | Type | Part | (μC/g) | thousand images | thousand images |
| Example 1 | (1) | (S1) | 1.8 | −48.1 | A | A |
| Example 2 | (1) | (S2) | 1.6 | −51.3 | A | A |
| Example 3 | (1) | (S3) | 1.8 | −52.0 | A | A |
| Example 4 | (1) | (S4) | 1.8 | −52.8 | A | A |
| Example 5 | (1) | (S5) | 2.4 | −47.2 | A | A |
| Example 6 | (1) | (S6) | 1.8 | −46.9 | A | B |
| Example 7 | (1) | (S7) | 1.8 | −45.2 | A | B |
| Example 8 | (1) | (S8) | 1.4 | −52.9 | A | B |
| Example 9 | (1) | (S9) | 2.8 | −47.0 | A | B |
| Example 10 | (1) | (S10) | 3.3 | −55.1 | A | B |
| Example 11 | (1) | (S11) | 4.0 | −60.1 | A | B |
| Example 12 | (1) | (S12) | 2.0 | −40.2 | A | B |
| Example 13 | (1) | (S13) | 2.0 | −41.8 | A | B |
| Example 14 | (1) | (S14) | 2.0 | −44.2 | A | B |
| Example 15 | (1) | (S15) | 1.8 | −45.8 | B | C |
| Example 16 | (1) | (S16) | 2.0 | −52.3 | B | C |
| Example 17 | (1) | (S17) | 2.0 | −46.5 | C | C |

TABLE 4-continued

| | | | | | | |
|---|---|---|---|---|---|---|
| Example 18 | (2) | (S1) | 1.8 | −47.7 | A | B |
| Example 19 | (3) | (S1) | 1.8 | −49.8 | A | B |
| Example 20 | (4) | (S1) | 1.8 | −46.5 | B | B |
| Example 21 | (5) | (S1) | 1.8 | −42.3 | A | B |
| Example 22 | (6) | (S1) | 1.8 | −40.4 | A | B |

| | Charge holding property of toner | Crack on photoreceptor (image quality) | | |
|---|---|---|---|---|
| | After printing 30 thousand images | After printing 5 thousand images | After printing 15 thousand images | After printing 30 thousand images |
| Example 1 | A | A | A | A |
| Example 2 | A | A | A | A |
| Example 3 | A | A | A | A |
| Example 4 | A | A | A | A |
| Example 5 | A | A | A | A |
| Example 6 | B | A | B | B |
| Example 7 | B | A | B | B |
| Example 8 | C | A | B | C |
| Example 9 | B | A | B | B |
| Example 10 | B | A | B | B |
| Example 11 | B | A | B | B |
| Example 12 | B | A | B | B |
| Example 13 | B | A | B | B |
| Example 14 | B | A | B | B |
| Example 15 | C | B | C | C |
| Example 16 | C | B | C | C |
| Example 17 | C | C | C | C |
| Example 18 | B | A | B | B |
| Example 19 | B | A | B | B |
| Example 20 | C | B | B | C |
| Example 21 | C | A | B | C |
| Example 22 | C | A | B | C |

TABLE 5

| | Developer | | | | | |
|---|---|---|---|---|---|---|
| | | Surface treated | | Charge holding property of toner | | |
| | Toner | silica particles | | Initial stage | After printing 5 | After printing 15 |
| | particles | Type | part | (μC/g) | thousand images | thousand images |
| Comparative Example 1 | (1) | (SC1) | 1.8 | −60.1 | B | B |
| Comparative Example 2 | (1) | (SC2) | 2.4 | −53.0 | B | C |
| Comparative Example 3 | (1) | (SC3) | 1.2 | −55.4 | C | D |
| Comparative Example 4 | (1) | (SC4) | 3.6 | −57.3 | C | D |
| Comparative Example 5 | (1) | (SC5) | 5.2 | −63.3 | D | D |
| Comparative Example 6 | (1) | (SC6) | 1.8 | −38.2 | D | D |
| Comparative Example 7 | (7) | S1 | 1.8 | −55.3 | C | C |
| Comparative Example 8 | (8) | S1 | 1.8 | −50.6 | C | C |

| | Charge holding property of toner | Crack on photoreceptor (image quality) | | |
|---|---|---|---|---|
| | After printing 30 thousand images | After printing 5 thousand images | After printing 15 thousand images | After printing 30 thousand images |
| Comparative Example 1 | C | C | D | D |
| Comparative Example 2 | D | B | D | D |
| Comparative Example 3 | D | C | D | D |
| Comparative Example 4 | D | D | D | D |

TABLE 5-continued

| | | | | |
|---|---|---|---|---|
| Comparative Example 5 | D | D | D | D |
| Comparative Example 6 | D | D | D | D |
| Comparative Example 7 | D | C | D | D |
| Comparative Example 8 | D | C | D | D |

It is possible to recognize from the above results that high charge holding properties of the toners are achieved and crack on the photoreceptor is prevented in the examples as compared with the comparative examples.

It is possible to recognize that high charge holding properties of the toners are achieved and crack on the photoreceptor is prevented especially in Examples 1 to 5, in which the silica particles with the compression aggregation degrees from 80% to 93% and particle compression ratios from 0.25 to 0.36 are applied as external additives, as compared with the other examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

kneaded and pulverized toner particles that contain a binder resin and a release agent, the release agent being partially exposed; and an external additive that contains silica particles having a compression aggregation degree of from 60% to 95% and a particle compression ratio of from 0.20 to 0.40.

2. The electrostatic charge image developing toner according to claim 1, wherein an average equivalent circle diameter of the silica particles is from 40 nm to 200 nm.

3. The electrostatic charge image developing toner according to claim 1, wherein a particle dispersion degree of the silica particles is from 90% to 100%.

4. The electrostatic charge image developing toner according to claim 1, wherein an average circularity of the silica particles is from 0.85 to 0.98.

5. The electrostatic charge image developing toner according to claim 1, wherein the silica particles are sol-gel silica particles.

6. The electrostatic charge image developing toner according to claim 1, wherein the binder resin is polyester resin.

7. The electrostatic charge image developing toner according to claim 1, wherein the silica particles are silica particles that are surface-treated with a siloxane compound having a viscosity of from 1,000 cSt to 50,000 cSt, and a surface attachment amount of the siloxane compound is from 0.01% by weight to 5% by weight.

8. The electrostatic charge image developing toner according to claim 7, wherein the siloxane compound is silicone oil.

9. An electrostatic charge image developer comprising:

the electrostatic charge image developing toner according to claim 1.

10. A toner cartridge comprising:

a container that contains the electrostatic charge image developing toner according to claim 1, wherein the toner cartridge is detachable from an image forming apparatus.

* * * * *